US010980304B2

(12) United States Patent
Volmer

(10) Patent No.: US 10,980,304 B2
(45) Date of Patent: Apr. 20, 2021

(54) BRIM CLIP WITH DUAL LIGHTING SYSTEMS

(71) Applicant: Volmer Enterprises, Inc., Loveland, CO (US)

(72) Inventor: Jason R. Volmer, Vancouver, WA (US)

(73) Assignee: Volmer Enterprises, Inc., Loveland, CO (US)

( * ) Notice: Subject to any disclaimer, the term of this patent is extended or adjusted under 35 U.S.C. 154(b) by 302 days.

(21) Appl. No.: 16/168,520

(22) Filed: Oct. 23, 2018

(65) Prior Publication Data

US 2019/0053561 A1 Feb. 21, 2019

Related U.S. Application Data

(63) Continuation-in-part of application No. 15/463,416, filed on Mar. 20, 2017, now Pat. No. 10,104,928, (Continued)

(51) Int. Cl.
*A42B 1/24* (2021.01)
*A42B 1/244* (2021.01)
(Continued)

(52) U.S. Cl.
CPC ..... *A42B 1/244* (2013.01); *F21L 4/04* (2013.01); *F21V 21/0885* (2013.01)

(58) Field of Classification Search
CPC ..... A42B 1/244; F21L 4/04; F21V 21/0885
See application file for complete search history.

(56) References Cited

U.S. PATENT DOCUMENTS 5,822,636 A 10/1998 Cho
D411,220 S 6/1999 Surabian
(Continued)

FOREIGN PATENT DOCUMENTS

CN 104000339 8/2014
CN 203963452 11/2014
(Continued)

OTHER PUBLICATIONS

XCSOURCE(R) 360 degree rotary backpack hat rec-mounts clip clamp mount for GoPro www.amazon.co.uk (available at least as early as Jul. 9, 2015).
(Continued)

*Primary Examiner* — Robert Sandy
(74) *Attorney, Agent, or Firm* — Don V. Kelly; Evans & Dixon, L.L.C.

(57) ABSTRACT

A clip for mounting on a hat brim includes a first panel and a second panel. The first and second panels respectively have a length, width, top surface, bottom surface, proximal end and distal end. The first panel and second panel are each resiliently connected at their distal ends to a nose segment. The second panel has a wedge-shaped portion in which the width of the wedge-shaped portion increases from the distal end of the panel toward the proximal end of the panel. A first light system connects to the first panel. The first light system has at least one light emitter. A second light system depends from the second panel. The second light system has at least one light emitter.

20 Claims, 54 Drawing Sheets

Related U.S. Application Data which is a continuation-in-part of application No. 14/921,719, filed on Oct. 23, 2015, now Pat. No. 9,596,926.

(60) Provisional application No. 62/323,882, filed on Apr. 18, 2016.

(51) Int. Cl.
*F21L 4/04* (2006.01)
*F21V 21/088* (2006.01)

(56) References Cited

U.S. PATENT DOCUMENTS

| | | | | |
|---|---|---|---|---|
| 6,247,205 | B1 | 6/2001 | Damadian et al. | |
| D451,939 | S | 12/2001 | Roh | |
| 6,467,929 | B2 * | 10/2002 | Lee | A42B 1/242 362/190 |
| 7,044,615 | B2 | 5/2006 | Gesten | |
| 7,306,348 | B2 | 12/2007 | Quittner | |
| 8,602,662 | B1 | 12/2013 | Mans | |
| 8,857,775 | B1 | 10/2014 | Clearman et al. | |
| 8,979,398 | B2 | 3/2015 | Han et al. | |
| 9,033,596 | B2 | 5/2015 | Samuels | |
| 9,077,877 | B2 | 7/2015 | Fountain | |
| 10,465,887 | B1 * | 11/2019 | Levy | F21V 21/145 |
| 2004/0008157 | A1 | 1/2004 | Brubaker et al. | |
| 2004/0165109 | A1 | 8/2004 | Lee | |
| 2004/0204207 | A1 | 10/2004 | Parker | |
| 2005/0058317 | A1 | 3/2005 | Montgomery | |
| 2008/0201862 | A1 | 8/2008 | Menard-Flanagan | |
| 2008/0295295 | A1 | 12/2008 | Rogers | |
| 2009/0119819 | A1 | 5/2009 | Thompson | |
| 2009/0190333 | A1 | 7/2009 | Sohn | |
| 2010/0226641 | A1 | 9/2010 | Lowen | |
| 2011/0192951 | A1 | 8/2011 | Gooch | |
| 2012/0050607 | A1 | 3/2012 | Sims et al. | |
| 2014/0334661 | A1 | 11/2014 | Besgen | |
| 2015/0063777 | A1 | 3/2015 | Letke | |
| 2015/0143669 | A1 | 5/2015 | Pereira et al. | |
| 2015/0172538 | A1 | 6/2015 | Nordstrom et al. | |
| 2015/0177597 | A1 | 6/2015 | Harrison et al. | |
| 2015/0276188 | A1 * | 10/2015 | Osborn | F21V 23/023 362/106 |

FOREIGN PATENT DOCUMENTS

| | | |
|---|---|---|
| DE | 2821442 | 11/1979 |
| GB | 2489689 | 10/2012 |
| WO | 2014114765 | 7/2014 |
| WO | 2014184475 | 11/2014 |

OTHER PUBLICATIONS

SHILL swivel clip mount for GoPro www.bhphotovideo.com (available at least as early as Jul. 11, 2015).
Professional 360 degree rotary backpack camera bag rucksack cap rec-mounts versatile clip fast clamp mount for Gopro Hero 2 3 3+ www.amazon.co.uk (available at least as early as Jul. 9, 2015).
GOPRO Jaws: flex clamp mount—Eastern Mountain Sports www.ems.com (available at least as early as Jul. 14, 2015).
GoPro—Head Strap+Quickclip-camera head mount http://shop.gopro.com (available at least as early as Dec. 4, 2013).
Hatcams one size hat with universal camera mount www.amazon.com (available at least as early as Jul. 9, 2015).
Quick clamp snap pinch hat cap clip bullet camera mount for Vio POV POV1 www.ebay.com (available at least as early as Jul. 12, 2015).
Replay XD hat visor cap lapel baseball clip tilt shoulder mount—SC-RPHM http://stuntcams.com (available at least as early as Jul. 12, 2015).
SPYPOINT XHD-CM—Cap Mount www.spypoint.com (available at least as early as Oct. 4, 2015).
Shimano Sports Camera mounts www.shimano-sportcamera.com/us/accessory.php (available at least as early as Jul. 13, 2015).
Stealth Cam EPIC hat clip mount: sports & outdoors www.amazon.com/Stealth-Cam-EPIC-Clip-Mount/dp0B001M57HAS (available at least as early as Oct. 4, 2015).
Hat/Visor clip for small action video camera, ActionCam (magnetic mount) http://ped-products.com/index.php?dispatch=products.view&product id=175 (available at least as early as Oct. 4, 2015).
Looxcie ball cap clip LM-0003-00 B&H photo video www.bhphotovideo.com (available at least as early as Oct. 4, 2015).
Looxcie HD: NEXX http://item.rakuten.co.jp/nexx-mart/lx-hd-jp (available at least as early as Oct. 4, 2015).
Point hat clip/Princeton Tec http://princetontec.com/point-hat-clip (available at least as early as Oct. 11, 2015).
Streamaroo hat tripod and mount adaptor www.streamaroo.com (available at least as early as Jul. 9, 2015).
TOKK Wearable Personal Assistant—https://www.amazon.com/TOKK-Wearable-Assistant-Hands-Free-Bluetooth/dp/B01MXHGKBU?psc=1&SubscriptionId=AKIAILSHYYTFIVPWUY6Q&tag=duckduckgo-d-20&linkCode=xm2&camp=2025&creative=165953&creativeASIN=B01MXHGKBU.
Chatclip https://www.chatclip.com.
Atari Speaker Hat https://www.engadget.com/2017/07/20/atari-introduces-the-speakerhat/.
https://www.ebay.ca/itm/NEW-Warm-Beanie-Hat-Wireless-Bluetooth-Smart-Cap-Headset-Headphone-Speaker-Mic-/132363042423?var=&hash=item1ed173be77.
https://www.ebay.ca/itm/Hat-Bluetooth-Smart-Cap-Wireless-Headset-Headphone-Speaker-Mic-Talking-Baseball-/292383352137?var=&hash=item441367e549.
https://www.ebay.ca/itm/Fashion-Wireless-Bluetooth-Smart-Cap-Headset-Headphone-Speaker-Mic-Baseball-Hat-/173548919752?var=&hash=item2868525bc8.
https://www.ebay.ca/itm/Soft-Warm-Beanie-Hat-Bluetooth-Smart-Cap-Wireless-Headset-Headphone-Speaker-Mic-/401216817816?var=&hash=item5d6a62ca98.
https://www.ebay.ca/itm/Soft-Warm-Beanie-Hat-Wireless-Bluetooth-Smart-Cap-Headset-Headphone-Speaker-Mic-/382392705177?var=&hash=item590861a099.
https://www.ebay.ca/itm/New-Bluetooth-Handsfree-Headset-HAT-Smart-WIRELESS-Speaker-MUSIC-MIC-Warm-CAP-/283152881230?var=&hash=item41ed3a164e.
https://gadgetviper.com/bluetooth-neckband-headphones-review/.
https://www.ebay.co.uk/itm/Wireless-Bluetooth-Neckband-Sports-Headphones-Running-Gym-Cycle-for-Mobile-Phone-/361780471297.

* cited by examiner

BRIM CLIP WITH DUAL LIGHTING SYSTEMS

CROSS REFERENCE TO RELATED APPLICATION

This application is a continuation in part of U.S. patent application Ser. No. 15/463,416, now U.S. Pat. No. 10,104,928, which: a) is a continuation in part of U.S. patent application Ser. No. 14/921,719 filed on Oct. 23, 2015, now U.S. Pat. No. 9,596,926; and b) also claims the benefit of U.S. Provisional Patent Application No. 62/323,882 filed on Apr. 18, 2016. The entire contents of the foregoing applications are incorporated herein by reference.

STATEMENT REGARDING FEDERALLY SPONSORED RESEARCH OR DEVELOPMENT

Not applicable.

SEQUENCE LISTING, TABLE OR COMPUTER PROGRAM ON COMPACT DISC

Not applicable.

FIELD OF INVENTION

This invention relates generally to accessory mounts and more specifically to those mounts intended for attachment to headwear.

BACKGROUND OF THE INVENTION

The deployment of a headlamp positioned in the vicinity of a user's forehead is a long-known technique to provide hands free lighting when needed. One technique for deploying such hands-free lighting is to attach a headlamp to elastic bands that can circumscribe a user's head or helmet. An exemplary prior art accessory mounting band is shown in FIG. 11A. The elastic bands retain the light or lamp against the forehead while the user engages in a desired activity. This elastic band technique has also been used for deploying small, point-of-view cameras, such as the Go-Pro brand camera, on a user's head, hat or helmet. Many users eschew the elastic band mounts because of a variety of reasons, including vanity and discomfort.

Other techniques for deploying an accessory such as a light or point of view ("POV") camera involve attaching a mounting apparatus that is adapted to receive the light or camera to a baseball cap. The currently available mounts intended to attach to a baseball cap come in a variety of structural configurations. They all, however, suffer from a wide array of deficiencies. For example, one style of mount requires that the brim or bill of the hat be pierced. This prior art technique is shown in FIG. 11B. In this style mount, the accessory-receiving portion of the mount attaches to a post that pierces through the hat's brim. This type mount is undesirable because it physically deforms the subject cap in permanent fashion. Also, the hole through which the post is pierced can loosen with time, causing the mount to undesirably shake and wobble.

Other accessory mounts intended for attachment to the brim of a hat are known as well. Some mounts use an alligator clip arrangement that clips to the bill of a cap. With this type of mount, the alligator clip slides over the front of the cap bill and holds an accessory device either above or below the bill. An example of this prior art device is shown in FIG. 11C. The prototypical alligator clip is formed from two panels that are connected by a metal spring. The spring is positioned between the two panels and near one end of them. The interpositioned spring biases the panels so that their ends opposite the spring are forced into contact with each other. The inner surfaces of the panels are serrated in some form, assumedly on the assumption that such serration enhances the ability of the clip to grip whatever structure (e.g., cap bill) inserted between the two panels. Alligator clip mounts have several deficiencies which make their performance less than desirable for use with accessory devices. In one instance, the alligator clip is bulky and its portion that is positioned underneath the bill will provide a visual distraction or obstruction. Secondly, this type of clip focuses its gripping force and brim contacting surfaces at one end of the clip—the end not localized at the cap brim edge. As a result, alligator clip type mounts do not provide sufficient grip to keep a heavier device like a POV camera in place when the user is involved in any type of vigorous activity. During such activity the clip tends to slide transversely along the brim front causing the camera angle to change.

Some bill accessory mounts utilize as their bill attachment mechanism a molded plastic clip or formed metal clip. In contrast to the alligator clip mount that uses the force of a metal spring to urge the panels to a point of contact, this type of clip eschews the metal spring in favor of integrally molded or formed rigid panels resiliently connected at a meeting point. The clip attaches to a cap bill simply by pushing the cap bill between the clip's panels. Examples of this type of prior art mounting clip are shown in FIGS. 11D-11G. These types of clips are intended to hold onto the cap bill through some level of friction between the clip panels and the inserted bill. At best, these slip-on plastic or metal mounting clips work well with small, lightweight devices, like mini-LED lights, that mount below the brim of a cap (FIG. 11D). The currently available versions do not work well with heavier devices like POV cameras. In this respect the clips tend to slide across and off the cap bill because they: a) do not create enough clamping force with the bill; b) do not provide for sufficient frictional contact with the bill; or both. As a result, a user deploying one of the molded plastic or formed metal clips must restrict and monitor his or her physical movements so as not to move too violently and cause the POV camera to move or fall off the cap.

SUMMARY OF THE INVENTION

The preferred embodiment clip overcomes the deficits of the prior art and allows for the secure mounting of accessory devices on a hat brim. The device works particularly well when used to mount accessories on the brim (a/k/a bill) of a baseball cap. Such a brim typically has a front edge that has an edge ('front-to-back") curvature of certain radius. The brim also has a thickness. The brim also has a transverse curvature (also known as a "bend") of a certain radius. The preferred embodiment clip adapted for attachment to such a brim comprises a first (top) panel and a second (bottom) panel. The first and second panels respectively have a length, a width, a top surface, a bottom surface, a proximal end and a distal end.

The first panel and second panel each resiliently connect at their distal ends in general perpendicular fashion to a nose segment. The top of the nose segment is connected to the distal end of the first panel. The bottom of the nose segment is connected to the distal end of the second panel. The nose segment has a front-facing (outer) surface and a brim-facing (inner) surface. The top (outer) surface of the first panel includes mounting structure adapted (sized and shaped) to receive an accessory device such as a light or POV camera. This mounting structure is positioned on the first panel at the proximal end to ergonomically balance the mounted accessory.

Importantly and in contra-distinction to the prior art, the second panel has a wedge-shaped portion in which the width of the panel increases from the distal end of the panel to the proximal end of the panel. This allows the bottom of the clip to cut into and frictionally engage the bottom of the hat brim due to the transverse radius of the hat brim. This frictional engagement increases the purchase of the clip against the hat brim.

Also adding to the friction-creating contact between the preferred embodiment clip and hat brim is the fact that the clip has a plurality of convex and concave surfaces. For example, in the preferred embodiment, the bottom (inner) surface of the first panel is concave. This concavity has a radius closely equal to that of the transverse curvature of the brim. This allows for increased surface contact with the top of the hat brim and hence an increased frictional hold. A second friction augmenting feature is the shape of the second panel. In this respect, the top surface of the second panel is convex. The convexity has a radius closely equal to that of the transverse curvature of the brim. A third friction augmenting feature is built into the nose segment, which in the preferred embodiment has a plurality of concave surfaces that can mirror both the edge curvature and transverse curvature of the typical baseball cap. For example, in the preferred embodiment, the intermediate brim-facing surface of the nose segment is concave and the concavity closely approximates that of the edge curvature of the hat brim. Additionally, at the distal end of the second panel, the top surface of the second panel includes a channel. This channel too can have a convex floor and sidewall. This channel serves to gather the stitched border of fabric that is found on the undersurface of the brim about the brim's perimeter. By receiving this fabric, the brim-holding ability of the clip is enhanced.

The design of the inventive clip also has beneficial application as the foundation for a clip or clip system that allows for interchangeable attachment of end-pieces that can accommodate a variety of device mounting structures. This is done via an inventive system in which a clip body meeting the design of the above-described clip includes at its proximal end structure to releasably engage interchangeable end-pieces that each include a different accessory device mounting support. The system thus could include a plurality of end-pieces each directed to an accessory device having a different type of mounting structure. The system could also include a plurality of end-pieces directed to the same accessory (i.e., the same accessory mounting structure), but each end-piece has mounting structure of different physical characteristics, such as tall, short, offset to the left or offset to the right. In another embodiment, the design of the present invention clip and systems using a similarly structured clip body can be adapted to include a mount for holding a microphone or microphone jack (collectively referred to as a "microphone/jack"). The invention is also directed to an inventive system in which a clip body meeting the design of the above described clip releasably engages an insert that can be used to reduce the vertical spacing between the top and bottom panels of the clip body to allow the clip body to be used on brims of varying thicknesses. The system can include one or more interchangeable inserts of varying thicknesses, textures and size.

The brim-holding design of the inventive clip, clip system and clip body described above also have beneficial application in providing for a brim mountable dual light device. This allows the brim clip to provide for dual lighting, which is not available in the market today. The brim clip with dual light system is a clip for mounting on a hat brim. A preferred embodiment of this clip comprises a first panel and a second panel, the first and second panels respectively having a length, width, top surface, bottom surface, proximal end and distal end. The first panel and second panel are resiliently connected at their distal ends to a nose segment. The second panel has a wedge-shaped portion in which the width of the wedge-shaped portion increases from the distal end of the panel toward the proximal end of the panel. A first light system is connected to the first panel. The first light system has at least one first light emitter. A second light system depends from the second panel. The second light system has at least one second light emitter. The at least one first light emitter and the at least one second light emitter preferably emit light of different intensities.

In one embodiment, the clip with dual lighting systems includes a battery-holding compartment. The compartment is sized and shaped to hold batteries and place the batteries in electrical communication with either or both of the first light system and second system. In another embodiment, the first light system is held by a light holder and the top surface of the first panel at its proximal end includes structure that is sized and shaped to receive the light holder. This last embodiment enables the clip to hold and deploy a variety of aftermarket flashlights. In a more preferred embodiment the second light system or the at least one second light emitter is pivotable from the second panel. Similarly, the first light system or the at least one first light emitter of the first light system can be pivotable. The clip body is particularly useful in a system for interchangeable mounting of lighting devices on a hat brim.

As in the case of the inventive clip, clip system or clip body, the bottom surface of the first panel is preferably concave. The top surface of the second panel is convex and texturized. The brim facing surface of the nose segment is preferably concave. It is also preferable that the distal end of the second panel includes a channel in the top surface of the second panel and the channel has a floor and a sidewall. Similarly, it is preferable that the wedge-shaped portion of the second panel is formed by a pair of flaring side segments, each of which connects to a distal segment at an obtuse angle.

DETAILED DESCRIPTION

Figure 12A:
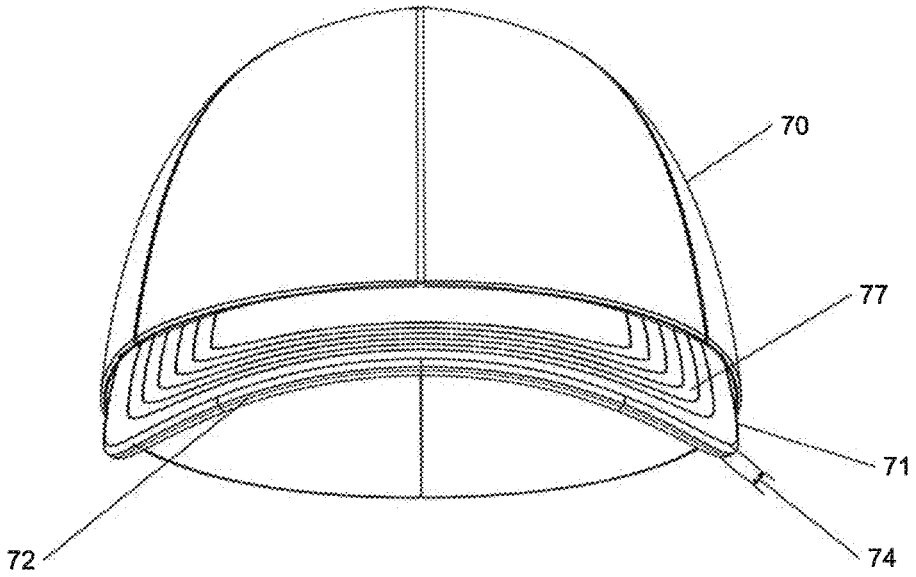
FIGS. 12A-12B depict a typical baseball cap upon which the present invention clip may be attached.
Figure 12B:
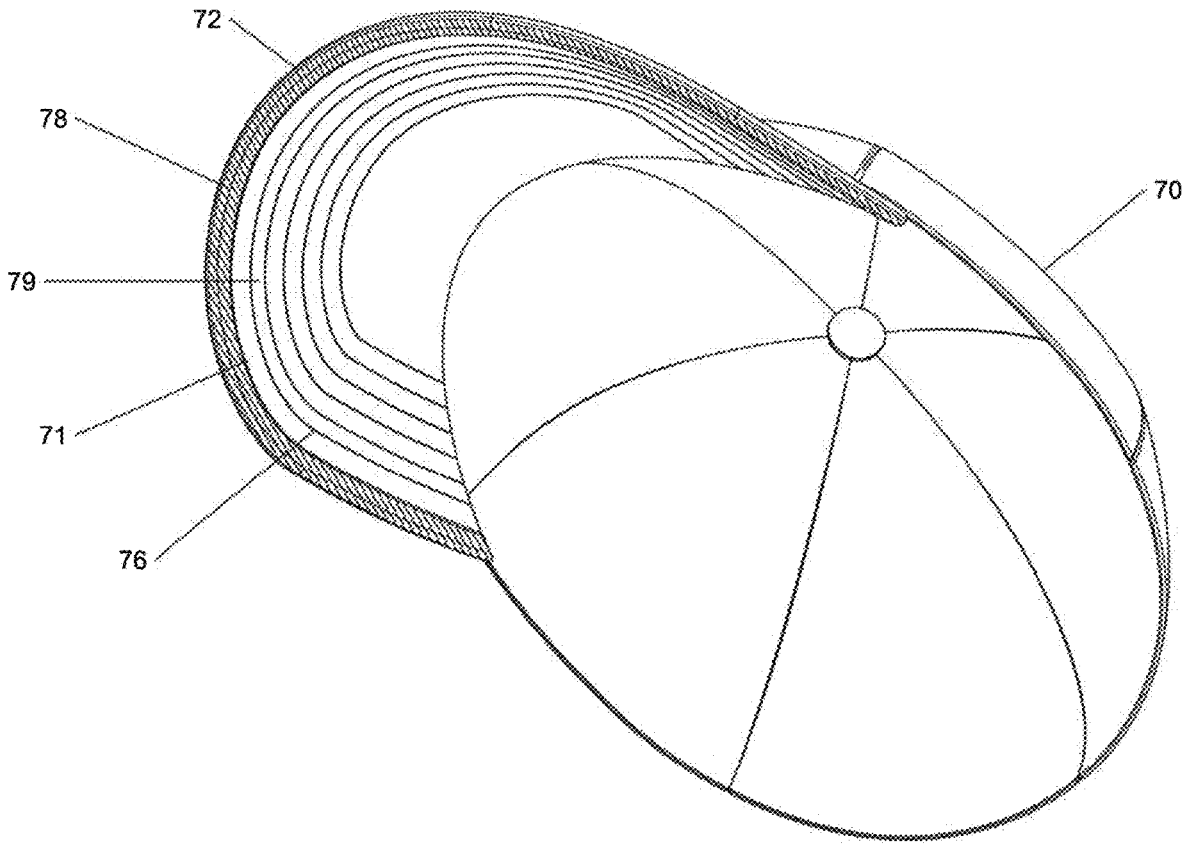
Figure 13A:
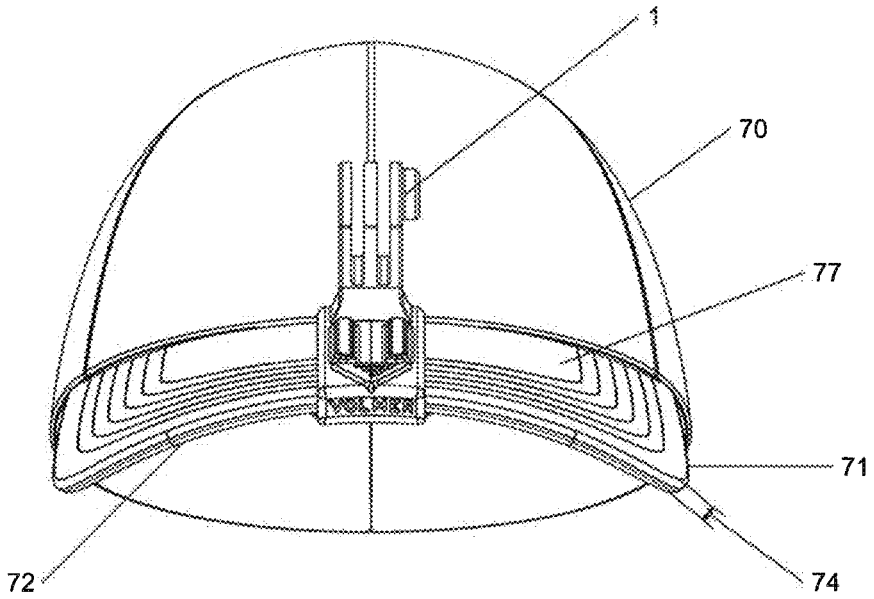
FIGS. 13A-13D depict a preferred embodiment of the present invention clip mounted to the brim of a baseball cap.
Figure 13B:
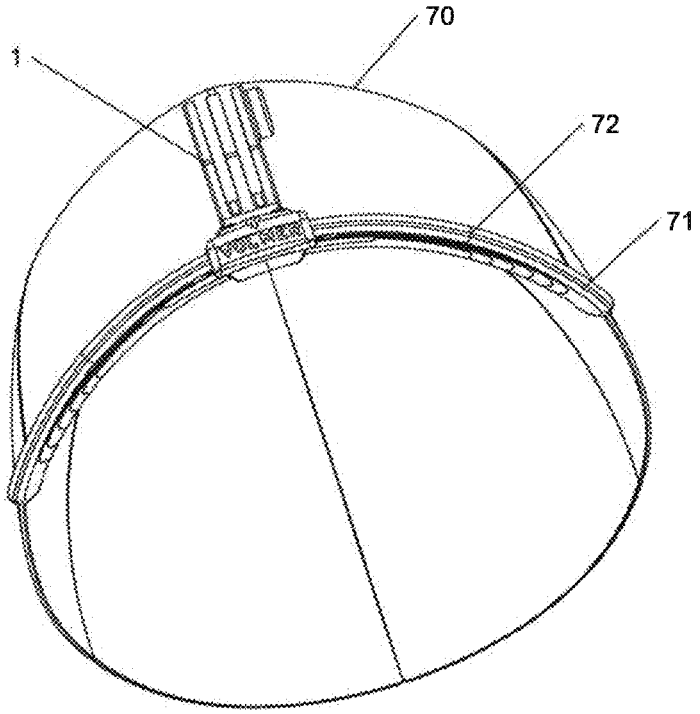
Figure 13C:
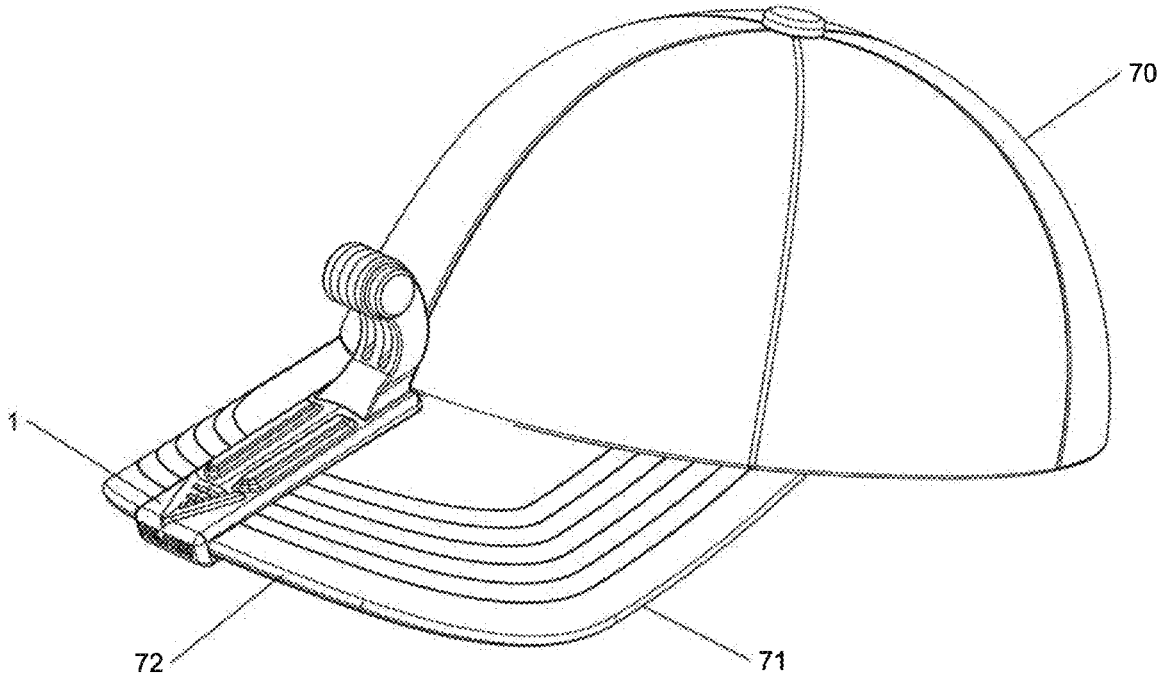
Figure 13D:
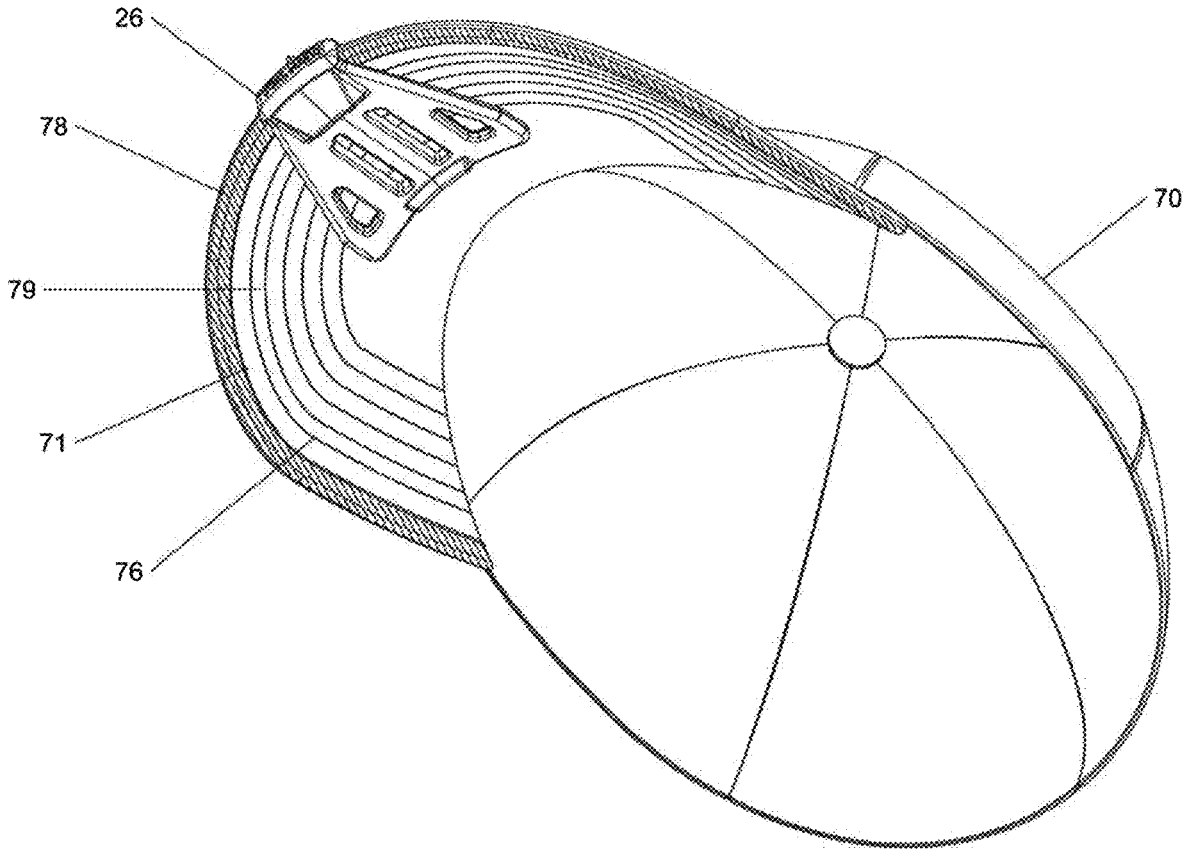
Figure 14:
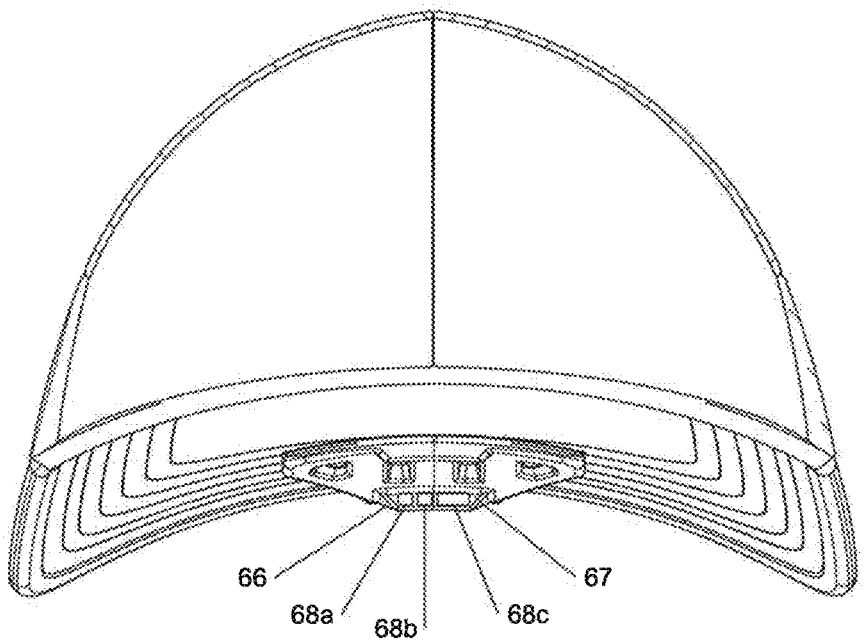
FIG. 14 depicts an embodiment of the present invention clip having a thumb tab that includes an indicator display that alerts the user to an operational status of a mounted accessory device.

A preferred embodiment of the present invention accessory mounting clip 1 and its preferred constituent features are shown in FIGS. 1-10, FIGS. 13A-13D and FIGS. 14-17. For reference purposes the term "distal end" is used to refer to that portion of the clip or its components that are furthest away from a user's head when the clip is deployed on the brim of a hat. The term "proximal end" is used to refer to that portion of the clip or its components that are nearest the user's head when the clip is deployed on the brim of a hat. The preferred embodiment clip works particularly well when used to mount accessories on the brim (a/k/a bill) 71 of a baseball cap 70 such as is shown in FIGS. 12A and 12B. As shown in FIGS. 12A and 12B, brim 71 typically has a front edge 72 that has a front to back curvature of certain radius. Brim 71 also has a thickness 74. Brim 71 also has a transverse curvature or bend of a certain radius that is best discerned when looking at the cap head on.

As shown by the figures, clip 1 is springless, which distinguishes the clip from the alligator clip style mounting clips. Preferred embodiment clip 1 is sized and shaped to attach to brim 71 by way of a pair of pinching panels 2, 3 between which brim 71 is inserted. Accordingly, clip 1 comprises a first panel 2 and a second panel 3. In common usage, first panel 2 is an upper (top) panel and second panel 3 is a lower (bottom) panel. First panel 2 and second panel 3 define space 80 into which a brim is inserted. First panel 2 and second panel 3 respectively have a length 7, 14, a width 8, 15, thickness 9, 16, a top surface 10, 18, a bottom surface 11, 17, a proximal end 6, 13 and a distal end 5, 12.

First panel 2 and second panel 3 each resiliently connect at their distal ends 5, 12 to nose segment 4. Nose segment 4 comprises a front facing (outer) surface 26 and a brim facing (inner) surface 27. Top 19 of nose segment 4 connects to distal end 5 of first panel 2. Bottom 20 of nose segment 4 connects to distal end 12 of second panel 3. Proximal end 13 of second panel 3 may be chamfered to better guide brim 71 into space 80 between panels 2, 3. Front facing surface 26 may include a logo or brand name 41 printed or embossed thereon Likewise, distal end 3 of panel 2 may also include a logo or brand name 41 printed or embossed thereon. Importantly and in contra-distinction to the prior art, second panel 3 has a wedge-shaped (a/k/a "delta-shaped") portion 52 in which the width 15 of panel 3 increases from its distal end 12 to its proximal end 13. In the preferred embodiment, wedged-shaped portion 52 is formed by a pair of flaring side segments 21, each of which leads into a distal segment 22. In the preferred embodiment distal segments 22 are parallel to each other.

The angular arrangement of side segments 21 with distal segments 22 of wedge-shaped portion 52 of lower panel 3 create fabric-catching edges 64 that are forced into the relatively softer cloth surface of brim bottom surface 76 when clip 1 is deployed on a brim 71. In the preferred embodiment, distal segments 22 meet flaring side segments 21 at an obtuse angle. Edges 64 allow second panel 3 of clip 1 to cut into and frictionally engage the bottom 76 of hat brim 71 due to the transverse curvature of brim 71. This frictional engagement increases the purchase of clip 1 against hat brim 71.

As seen in the figures, first panel 2 and second panel 3 adjoin nose segment 4. First panel 2 and second panel 3 are separated along almost their entire lengths by vertical space 80. At the distal end of clip 1, the height of vertical spacing 80 between first panel 2 and second panel 3 is roughly equal to thickness 74 of hat brim 71. As one moves from the distal end of clip 1 to its proximal end, spacing 80 decreases until panels 2, 3 make contact. Preferably, proximal end 13 of second panel 3 will touch panel 2 at a point about 75% of its length as measured from distal end 5. This decrease in spacing between panels 2, 3 increases frictional purchase of clip 1 against brim 71. The resilient connection of panels 2, 3 to nose segment 4 allows spacing 80 at the proximal end of clip 1 to increase via resilient deflection so as to receive a hat brim 71.

Figure 17:
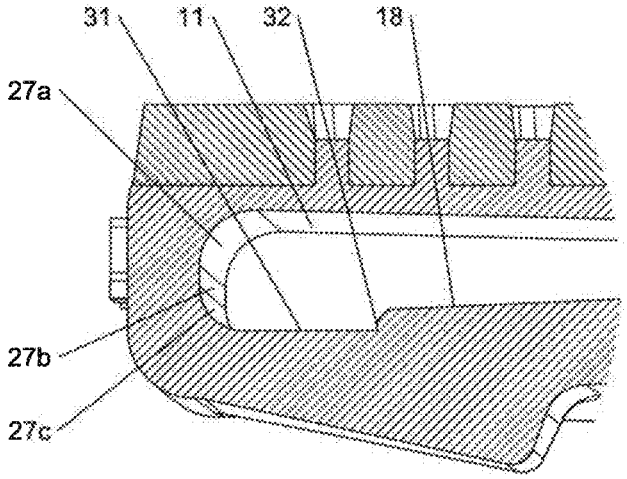
FIG. 17 is a detailed view of the distal area of the clip shown in section view in FIG. 7. The detailed area shows the channel and various convex and concave surfaces that can be included as part of the invention.
Figure 18:
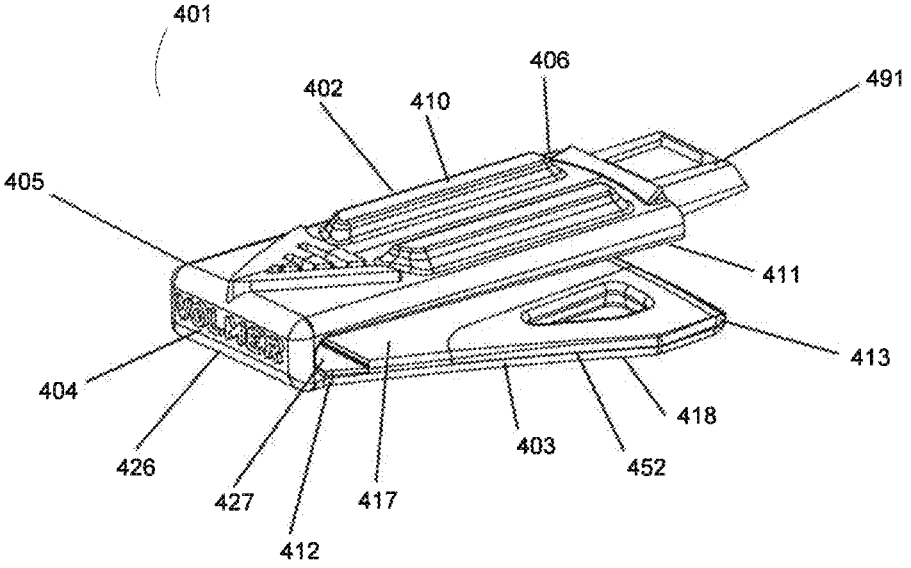
FIG. 18 is a perspective view of an embodiment clip body including structure at its proximal end for interchangeable attachment of end-pieces that can accommodate a variety of device mounting structures.
Figure 19:
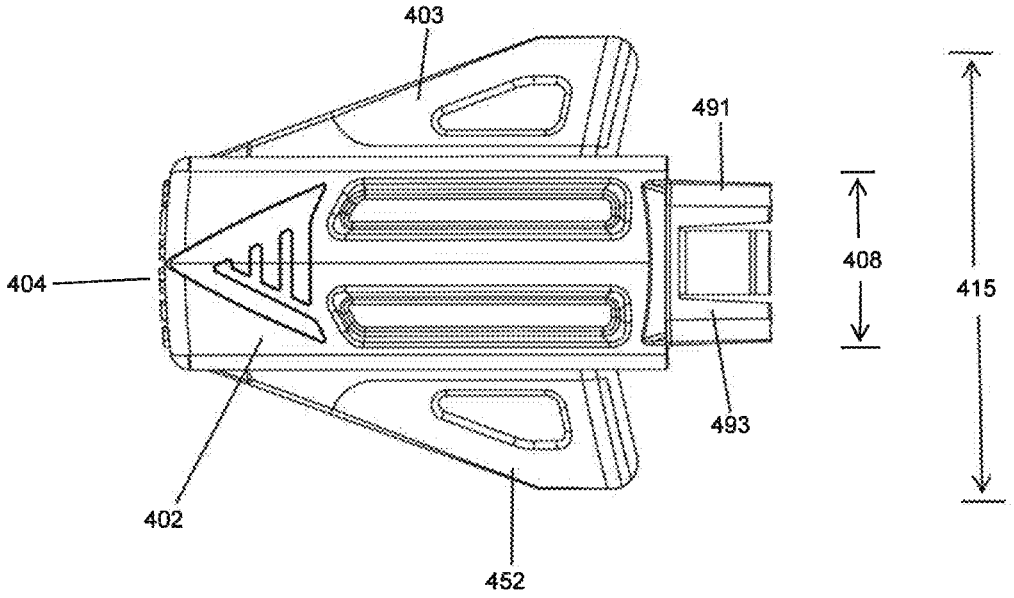
FIG. 19 is a top plan view of an embodiment clip body including structure at its proximal end for interchangeable attachment of end-pieces that can accommodate a variety of device mounting structures.
Figure 20:
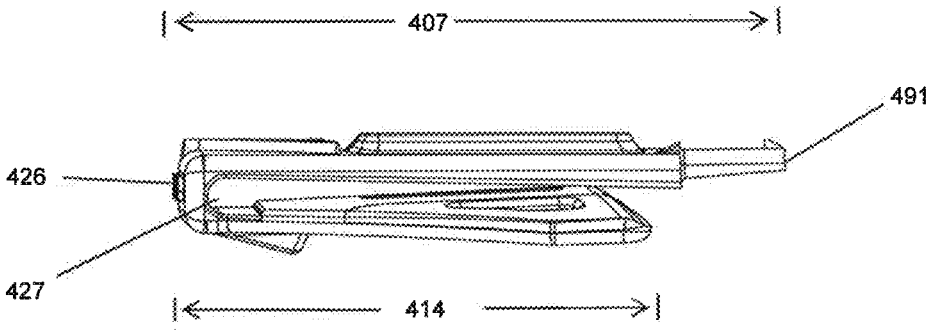
FIG. 20 is a right elevation view of an embodiment clip body including structure at its proximal end for interchangeable attachment of end-pieces that can accommodate a variety of device mounting structures.
Figure 21:
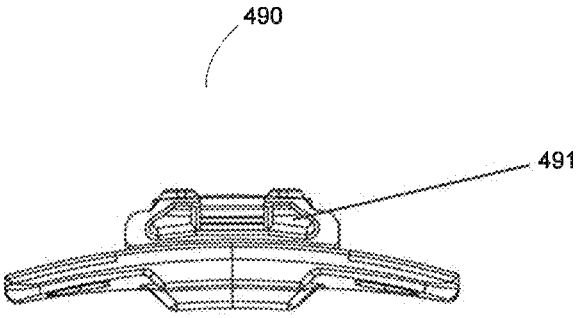
FIG. 21 is a rear elevation view of an embodimentclip body including structure at its proximal end for interchangeable attachment of end-pieces that can accommodate a variety of device mounting structures.
Figure 22:
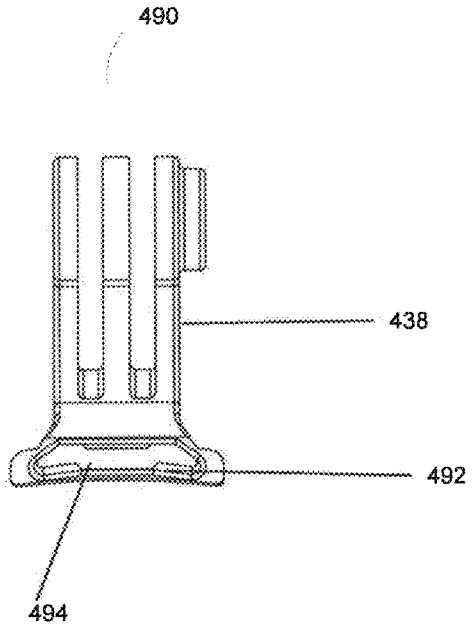
FIG. 22 is a front elevation view of an embodiment end-piece sized and shaped for interchangeable attachment to the proximal end of the clip body shown in FIGS. 18-21.
Figure 23:
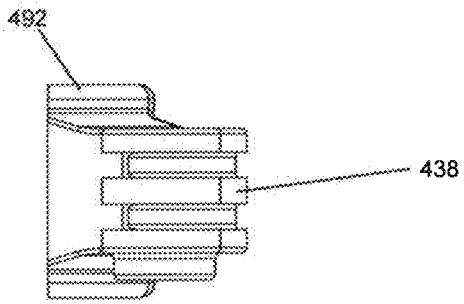
FIG. 23 is a top plan view of an embodiment end-piece sized and shaped for interchangeable attachment to the proximal end of the clip body shown in FIGS. 18-21.
Figure 24:
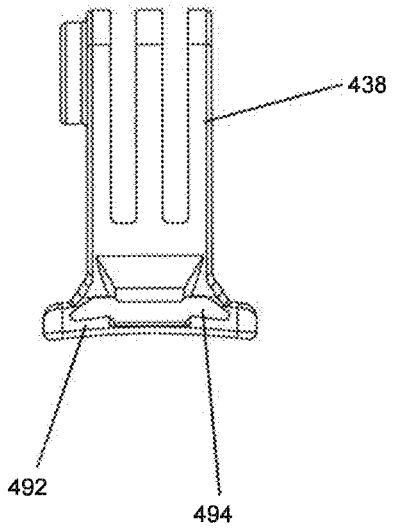
FIG. 24 is a rear elevation view of an embodiment end-piece sized and shaped for interchangeable attachment to the proximal end of the clip body shown in FIGS. 18-21.
Figure 25:
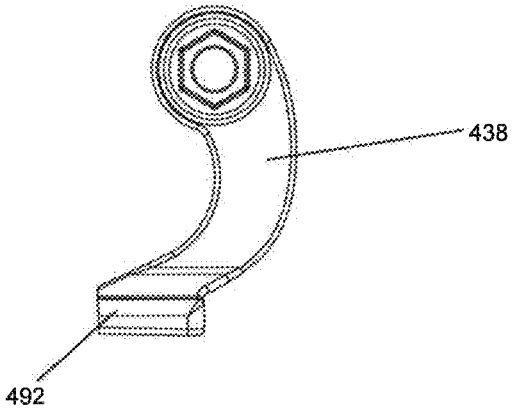
FIG. 25 is a right elevation view of an embodiment end-piece sized and shaped for interchangeable attachment to the proximal end of the clip body shown in FIGS. 18-21.
Figure 26A:
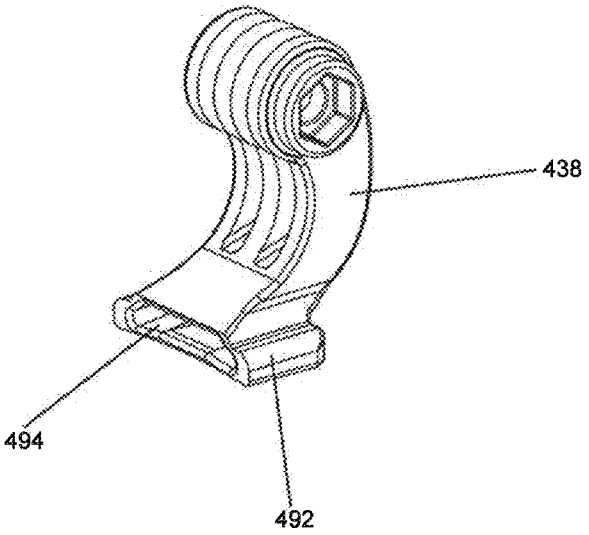
FIG. 26A is a perspective view of an embodiment end-piece sized and shaped for interchangeable attachment to the proximal end of the clip body shown in FIGS. 18-21.
Figure 26B:
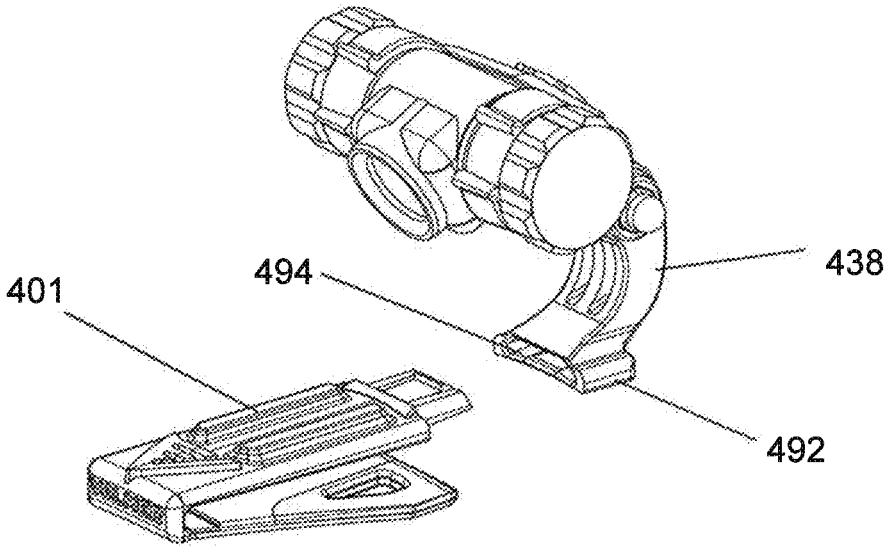
FIG. 26B is a perspective view of an embodiment system comprising a clip body and end-piece exemplarily deploying a light.
Figure 26C:
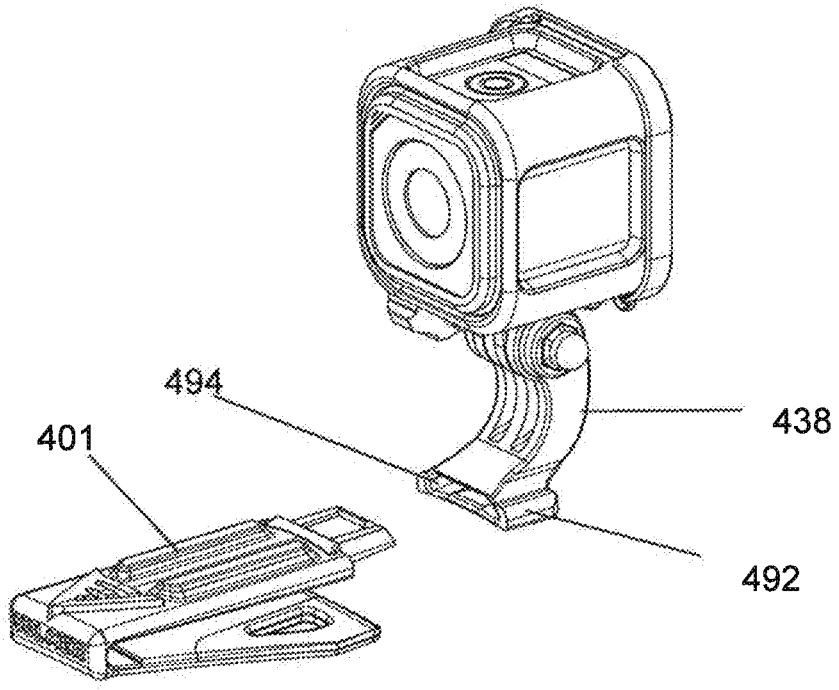
FIG. 26C is a perspective view of an embodiment system comprising a clip body and end-piece exemplarily deploying a POV camera.
Figure 27:
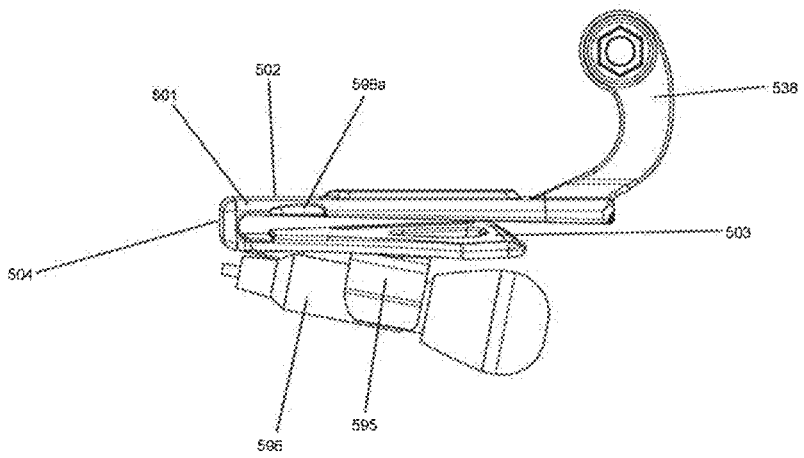
FIG. 27 is a right elevation view of an alternative embodiment clip including a mount sized and shaped to releasably hold a microphone/jack in electrical communication with an accessory device mounted to the clip.
Figure 28:
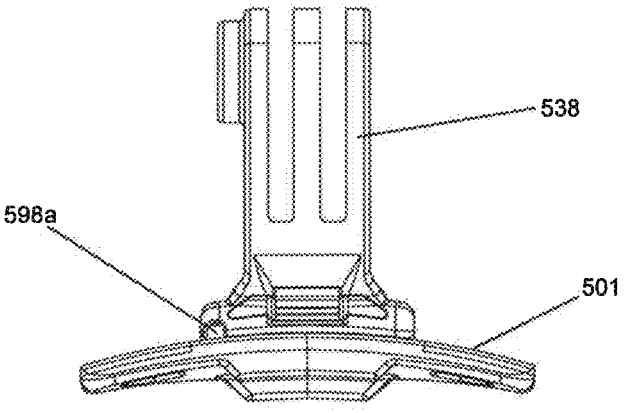
FIG. 28 is rear elevation view of an embodiment system showing an end-piece attached to a clip body, the clip body having an integrated channel sized and shaped to hold a wire extending from a microphone/jack mounted to the clip to a device mounted on the clip.

Also adding to the friction-creating contact between clip 1 and hat brim 71 is the fact that the clip can have one or more concave and convex surfaces that increase surface contact between the clip and hat brim. For example, as shown in the figures, bottom surface 11 of first panel 2 is concave. In the preferred embodiment, this concavity has a radius closely equal to that of transverse curvature of brim 71. This allows for increased surface contact between the top surface 77 of hat brim 71 and bottom surface 11 of panel 2 and hence an increased frictional hold. This increased frictional hold is augmented by the shape of second panel 3. In this respect, as shown in the embodiment shown in the figures, top surface 18 of second panel 3 is convex. The convexity preferably has a radius closely equal to that of transverse curvature of brim 71. This convexity may also be found in floor 31 of channel 30. Additionally, as best shown in FIG. 17, brim-facing, inner surface 27 of nose segment 4 may be concave in one or more dimensions. For example, constituent portions 27*a*, 27*b* and 27*c* may have a front-to-back concavity that more preferably mirrors that of the edge curvature of edge 72. Constituent portions 27*a*, 27*b* and 27*c* may also have a vertically oriented curvature to better receive the vertical curvature of brim edge 72. It is intended that these concave portions of nose 27 increase purchase against brim edge 72. Also, channel sidewall 32 is preferably formed in convex fashion to increase the hold of fabric border 79.

Preferred embodiment clip 1 includes cutouts 42 formed in proximal end 13 of second panel 3. Cutouts 42 reduce weight and allow proximal end 13 of panel 3 to flex more in relation to its distal end 12. This increased flexibility allows panel 3 to conform to the curvature of under surface 76 of brim 71 thereby increasing surface to surface contact between the clip and the hat brim.

As seen in the figures, top surface 10 of first panel 2 includes mounting structure 38 adapted (sized and shaped)

to receive an accessory device such as a light or POV camera. Mounting structure 38 may be integrally formed in first panel 2 as shown in the figures or may be mechanically attached. Mounting structure 38 of preferred embodiment clip 1 shown in the figures is particularly adapted to receive the mounting structure of a GoPro brand POV camera. Other mounting structures may be used. Unlike some prior art accessory mounting devices that place the mounting structure at the distal end of the device, mounting structure 38 of the present invention clip is positioned at the proximal end 6 of first panel 2.

Preferred embodiment clip 1 can include one or more enhancements to increase its brim-holding power. For example, all or part of top (inner) surface 18 of second, bottom panel 3 may be texturized to increase friction with bottom surface 76 of brim 71. Such texturizing can involve application of a rubberized surface to top surface 18. Alternatively or additively, top surface 18 may include a knurled surface, a roughened surface, a surface with upward facing micro-points or a surface with rough fibrous surface texture. By texturizing all or part of top surface 18 the coefficient of friction between clip top surface 18 and brim bottom surface 76 is increased. In addition, second panel 3 preferably becomes more flexible (compared to the distal portion) near the widest portions, which allows second panel 3 to better form to the curvature of brim 71.

In a preferred embodiment, the width of second panel 3 at its proximal end is 1.5 to 2.5 times the width of the first panel at its proximal end. Tests of various iterations of the inventive clip 1 have shown that clip 1 offers optimal frictional purchase against brim 71 when the width 15 of second panel 3 at its proximal end 13 is approximately 2 times the width 8 of the first panel 2 at its proximal end 6.

The shape and structure of nose segment 4 have been shown to also significantly increase the ability of clip 1 to resist movement on the bill of a conventional baseball cap. For example, nose segment 4 connects in general perpendicular relation to each of the first and second panels 2, 3. This allows front edge 72 of brim 71 to be pushed flush up against brim-facing surface 27 of nose segment 4. To further increase the frictional purchase of clip 1 on brim 71, distal end 12 of panel 3 includes a channel 30. Channel 30 has a floor 31 and a sidewall 32. Sidewall 32 rises to top surface 18 of second panel 3 at its distal end 12. The positioning of channel 30 relative to inner (brim-facing) surface 27 of nose portion 4 and the decreasing vertical space 80 between panels 2, 3 operate to force the proximal edge of fabric border 78 into sidewall 32, augmenting the frictional hold of the clip on brim 71. At the same time and also augmenting the frictional hold, brim edge 72 is forced into brim-facing surface 27.

The purpose of channel 30 will now be further explained. As seen in FIG. 12B, a typical brim of a baseball cap includes stitching 79 on the bottom surface 76 of brim 71. Stitching 79 defines a border 78 of cloth material between stitching 79 and brim front edge 72. This border 78 of cloth material (indicated by the cross-hatched area in FIG. 13D) typically has a width and an additional thickness. For a large amount of readily purchasable baseball caps, the width of cloth material border 78 falls within a range of 0.584 to 0.686 centimeters. Channel 30 is preferably sized to fall within that range. When clip 1 is fully seated on brim 71 such that brim edge 72 is in contact with brim-facing surface 27 of nose portion 4, border 78 of cloth material tends to drop in and be retained by sidewall 32 of channel 30. This retention of border material 78 by channel 30 increases the frictional hold clip 1 has on brim 70 particularly when channel 30 is constructed in the preferred embodiment as is immediately described. In this respect floor 31 of channel 30 connects to sidewall 32 in general perpendicular relation. Similarly, in the preferred embodiment sidewall 32 of channel 30 connects to panel 3 in general perpendicular relation at a corner 54. Corner 54 may include a bevel 55 to aid in insertion and removal of brim 71 from clip 1. Corner 54 digs into bunched fabric of border material 78 and assists in retaining clip 1 in a fixed position on brim 71.

Figure 1:
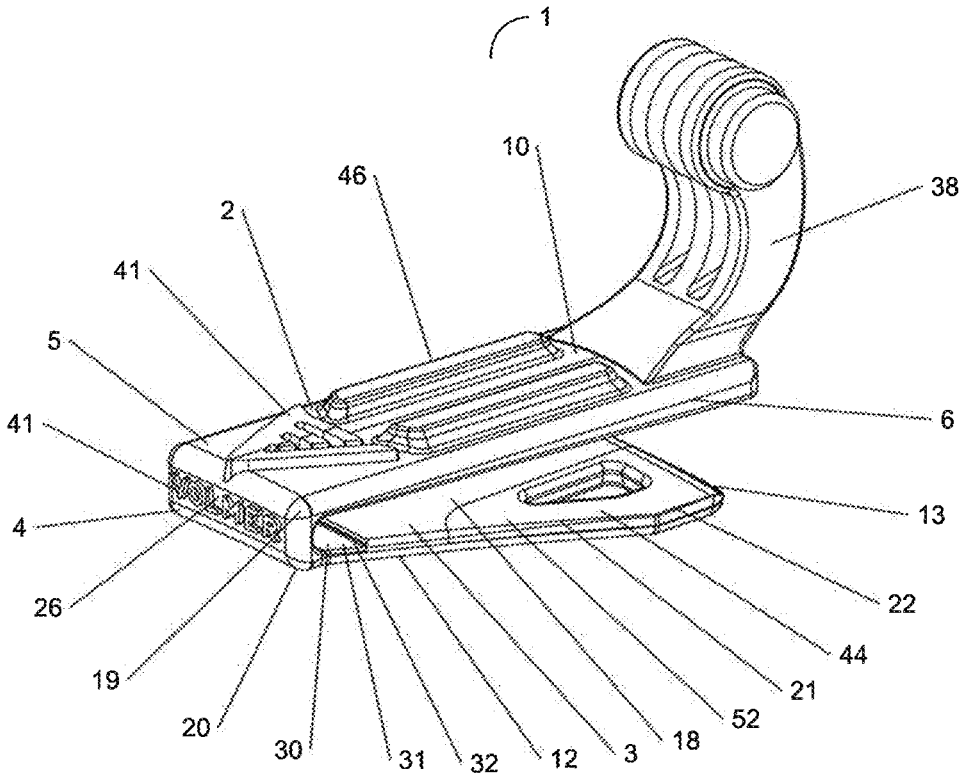
FIG. 1 is a front perspective view of a preferred embodiment of the accessory mounting clip of the present invention.
Figure 2:
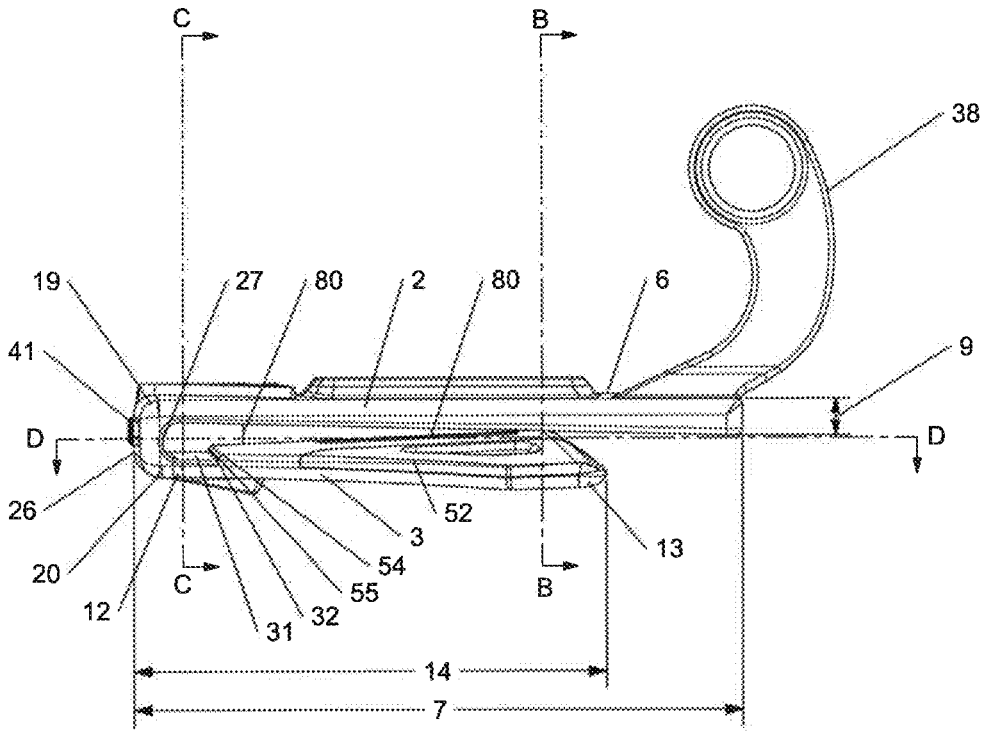
FIG. 2 is a right elevation view of a preferred embodiment of the accessory mounting clip of the present invention.
Figure 3:
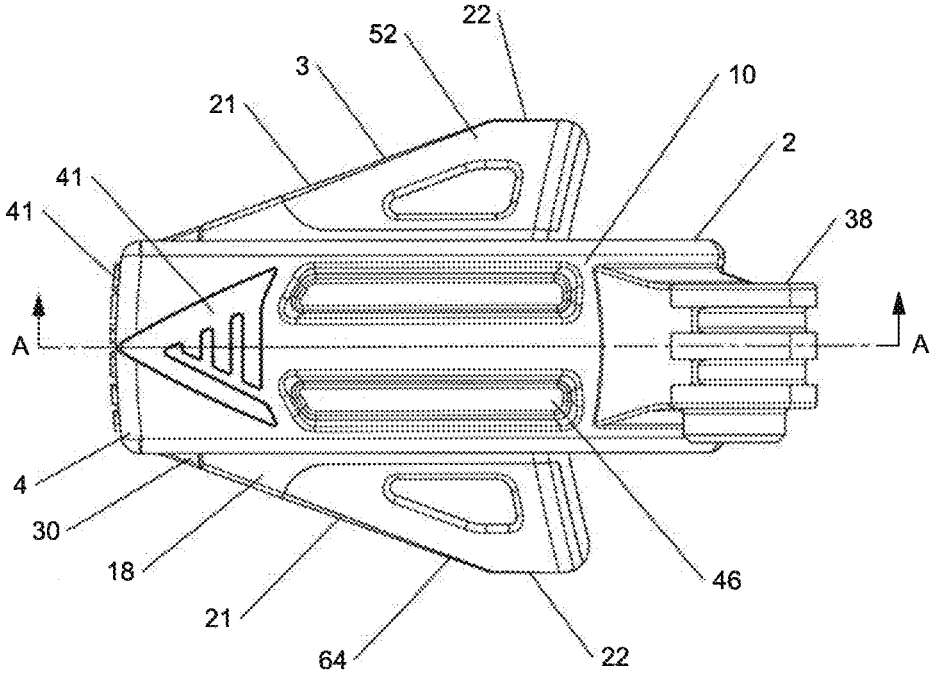
FIG. 3 is a top plan view a preferred embodiment of the accessory mounting clip of the present invention.
Figure 4:
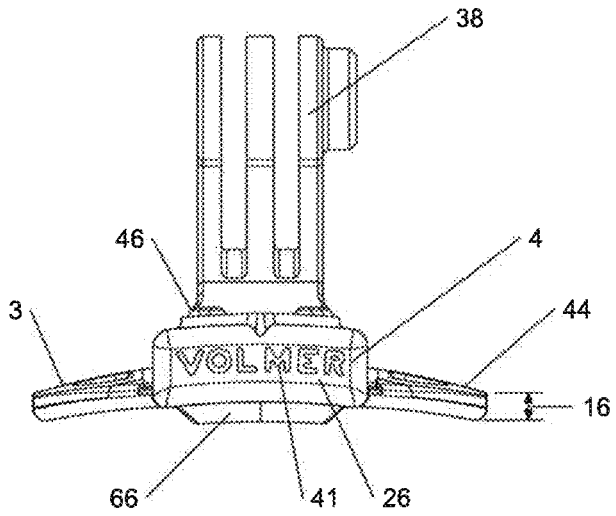
FIG. 4 is a front elevation view of a preferred embodiment of the accessory mounting clip of the present invention.
Figure 5:
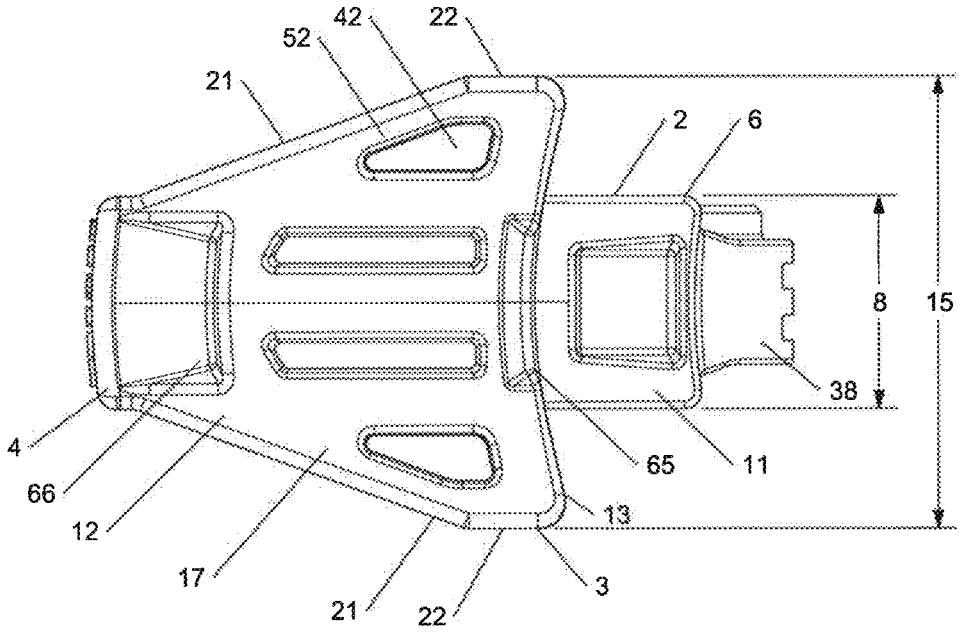
FIG. 5 is a bottom plan view of a preferred embodiment of the accessory mounting clip of the present invention.
Figure 6:
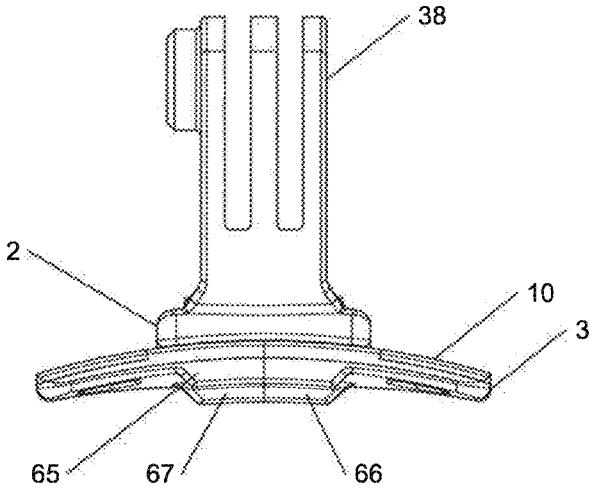
FIG. 6 is a rear elevation view of a preferred embodiment of the accessory mounting clip of the present invention.
Figure 7:
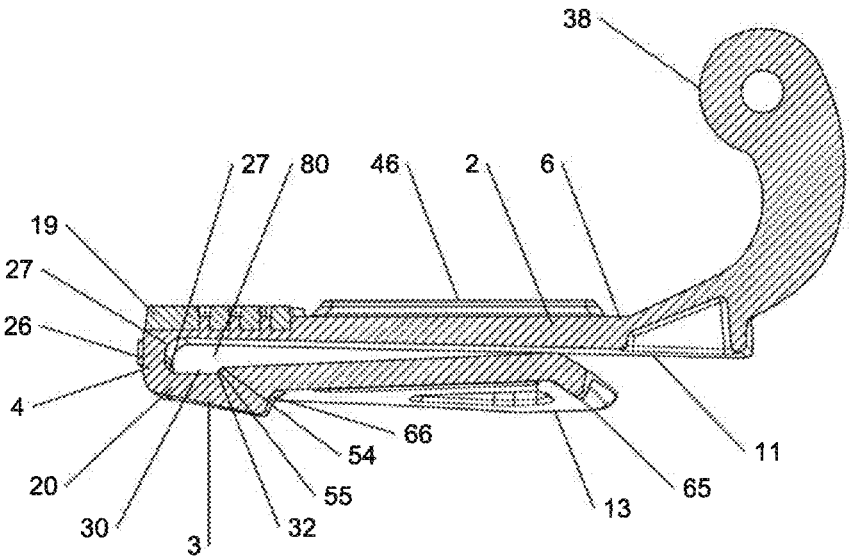
FIG. 7 is a side cross-sectional view of a preferred embodiment of the accessory mounting clip of the present invention taken along line A-A of FIG. 3.
Figure 8:
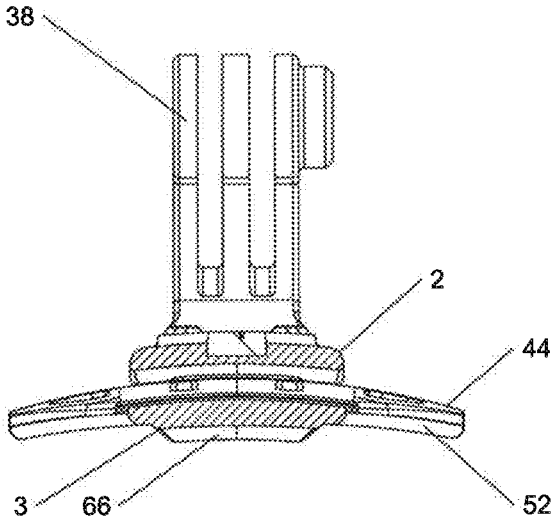
FIG. 8 is a front cross-sectional view of a preferred embodiment of the accessory mounting clip of the present invention taken along line C-C of FIG. 2.
Figure 9:
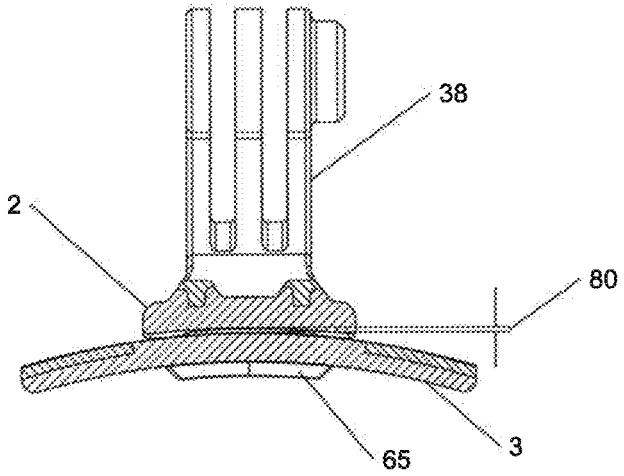
FIG. 9 is a front cross-sectional view of a preferred embodiment of the accessory mounting clip of the present invention taken along line B-B of FIG. 2.
Figure 10:
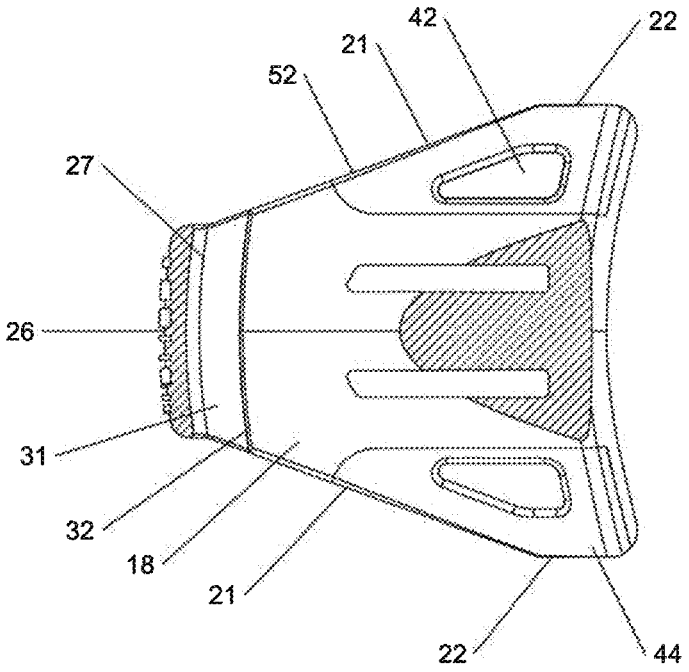
FIG. 10 is a top plan cross-sectional view of a preferred embodiment of the accessory mounting clip of the present invention taken along line D-D of FIG. 2.
Figure 11A:
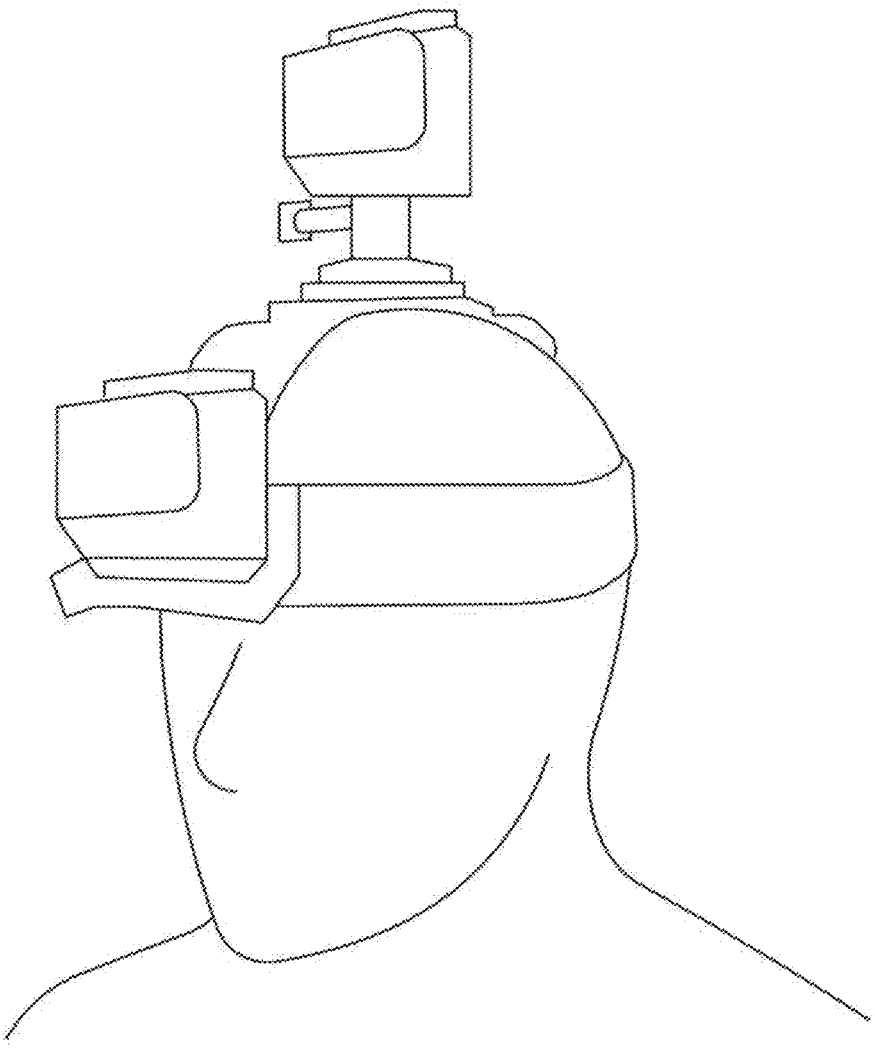
FIG. 11A PRIOR ART
FIGS. 11A-11G depict exemplary prior art devices that are intended to attach to a user's head or the brim of a hat for purposes of mounting an accessory device.
Figure 11B:
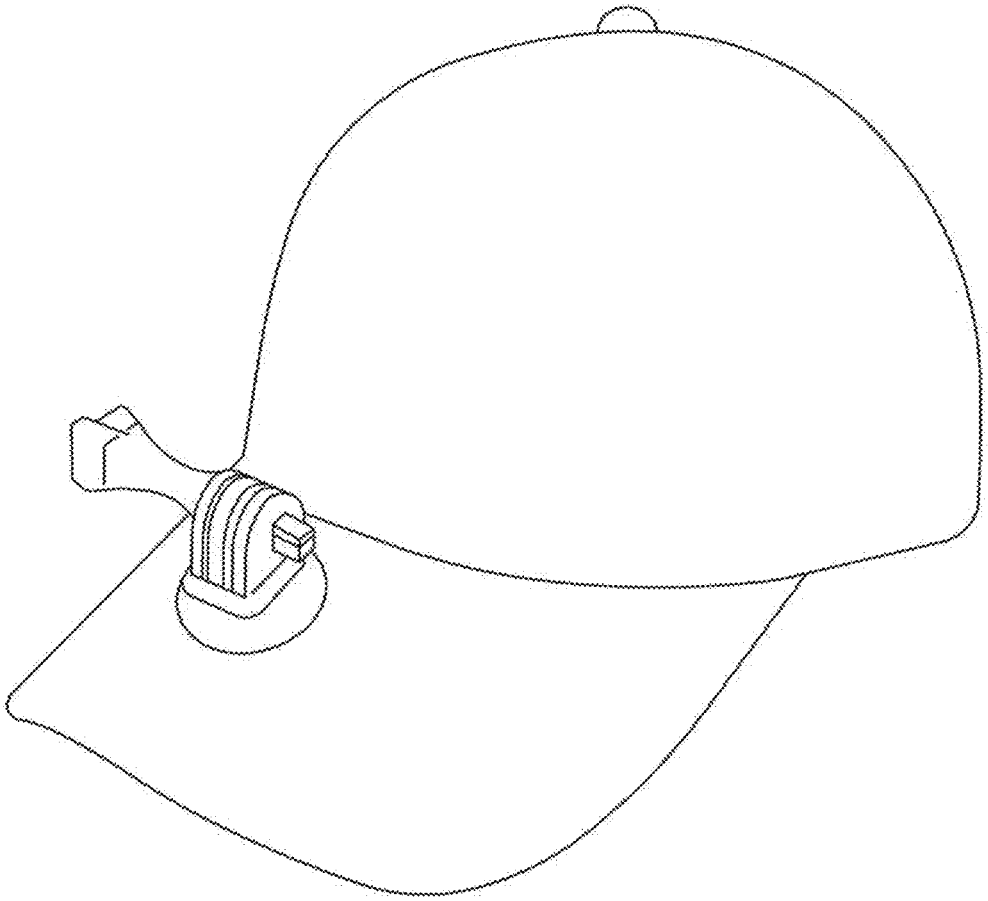
FIG. 11B PRIOR ART
Figure 11C:
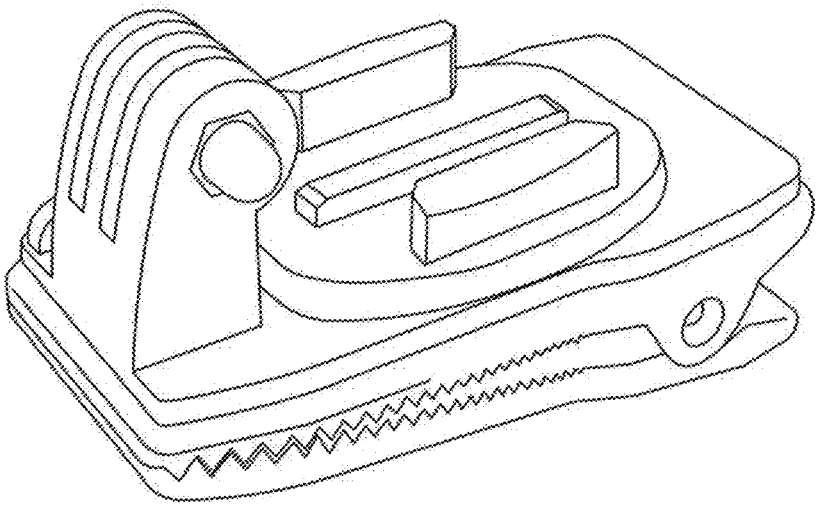
FIG. 11C PRIOR ART
Figure 11D:
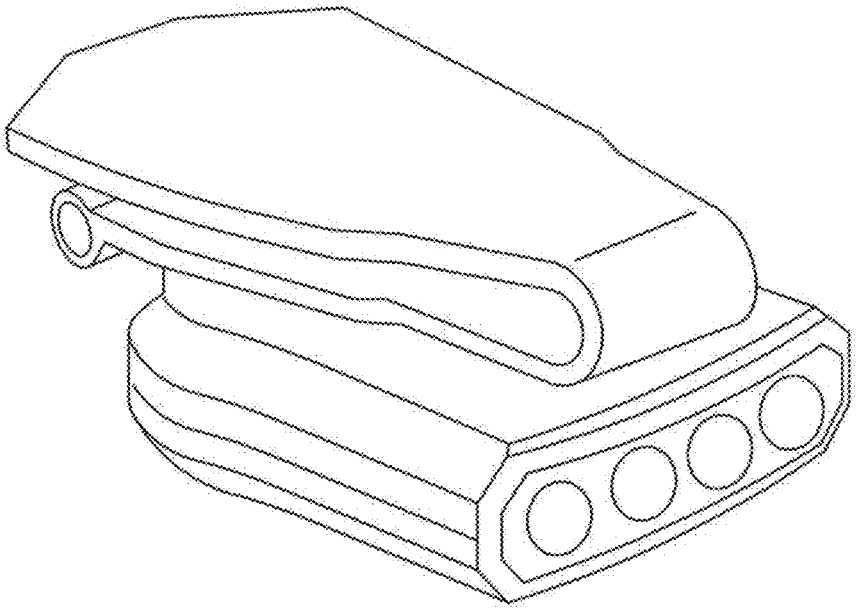
FIG. 11D PRIOR ART
Figure 11E:
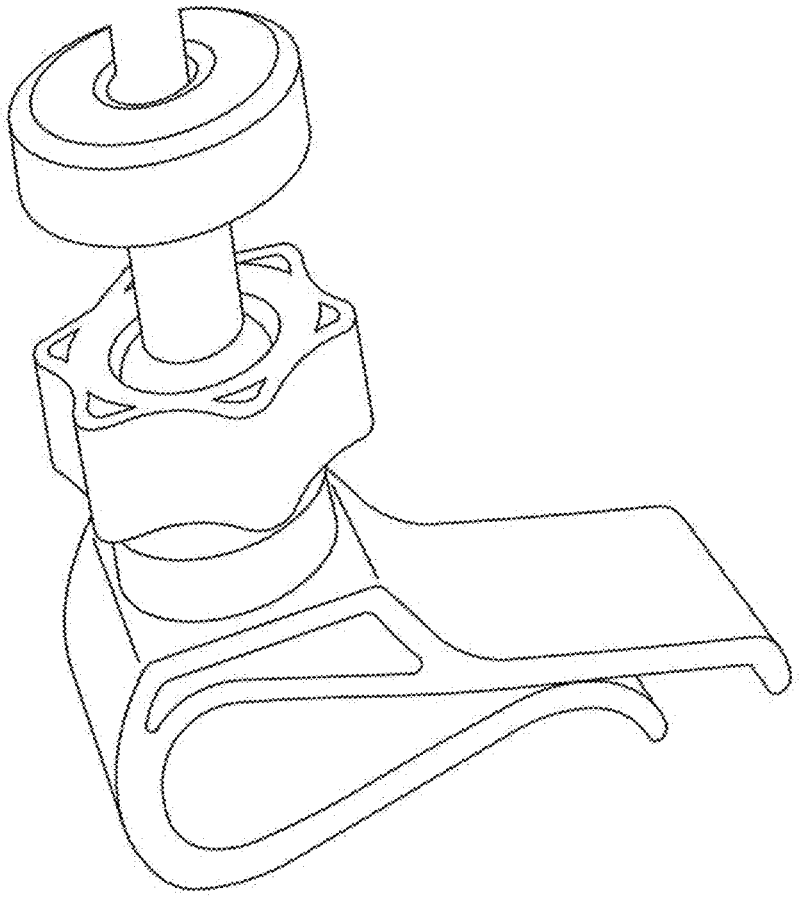
FIG. 11E PRIOR ART
Figure 11F:
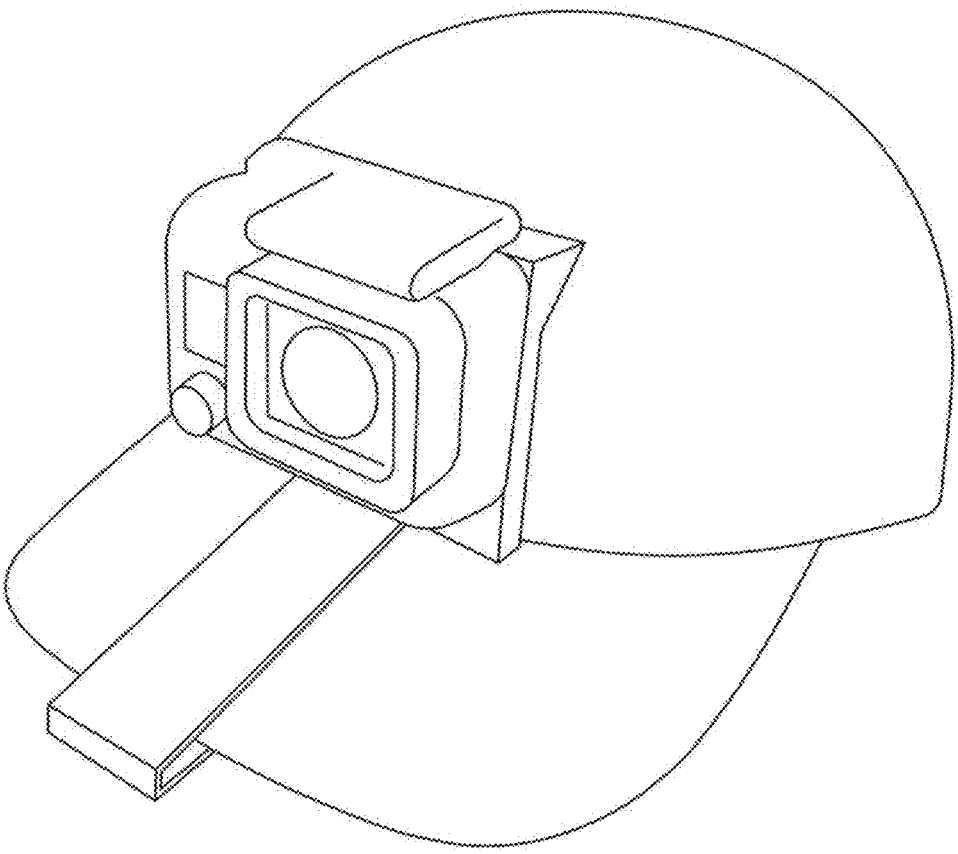
FIG. 11F PRIOR ART
Figure 11G:
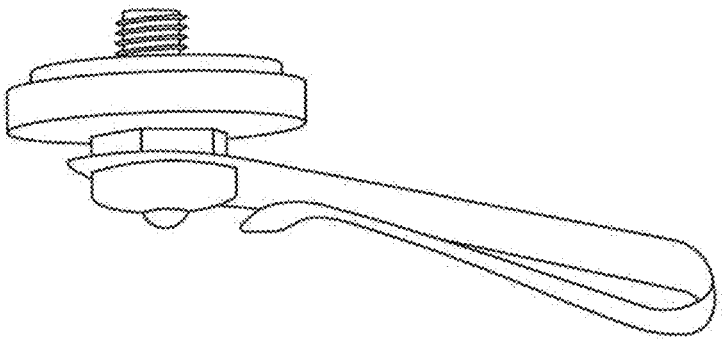
FIG. 11G PRIOR ART

As noted, channel 30 may be further enhanced such that floor 31 of channel 30 follows the convex contour (best seen in FIG. 4) of top surface 18 of panel 3 and is thus itself upwardly convex. The convexity of floor 31 has a preferred radius closely equal to that of transverse curvature of brim 71. Also, as can be best seen in FIGS. 7, 10 and 14 brim-facing surface 27 of nose segment 4 is preferably concave in the front-to-back direction and that concavity can have an optimal radius closely equal to that of the radius of the edge curvature of brim edge 72. This concavity in inner, brim-facing surface 27 increases the surface area contact of clip 1 with brim edge 72. As with top surface 18 of panel 3, brim facing surface 27 may be texturized to increase its purchase on brim edge 72. Additionally, as is shown in FIG. 10, sidewall 32 is convex and the radius of the convexity is preferably closely equal to the radius of curvature of brim front edge 72. This convexity allows sidewall 32 to have a larger contact surface with bunched fabric border material 79.

Preferred embodiment clip 1 may include elongate ribs 46 on top surface 10 of panel 2. Ribs 46 add structural rigidity to first panel 2, which prevents it from twisting and flexing when the weight of an accessory item is applied to clip 1. In the depicted embodiment ribs 46 are longitudinally oriented on panel 2, but can be also be oriented transversely or diagonally on panel 2 to achieve a desired directional rigidity. Ribs 46 also serve as a rest stop or support for a camera or other device that can flip downward from mounting structure 38. Ribs 46 thereby protect the sensitive surfaces such as the lens surfaces of such cameras.

Figure 15A:
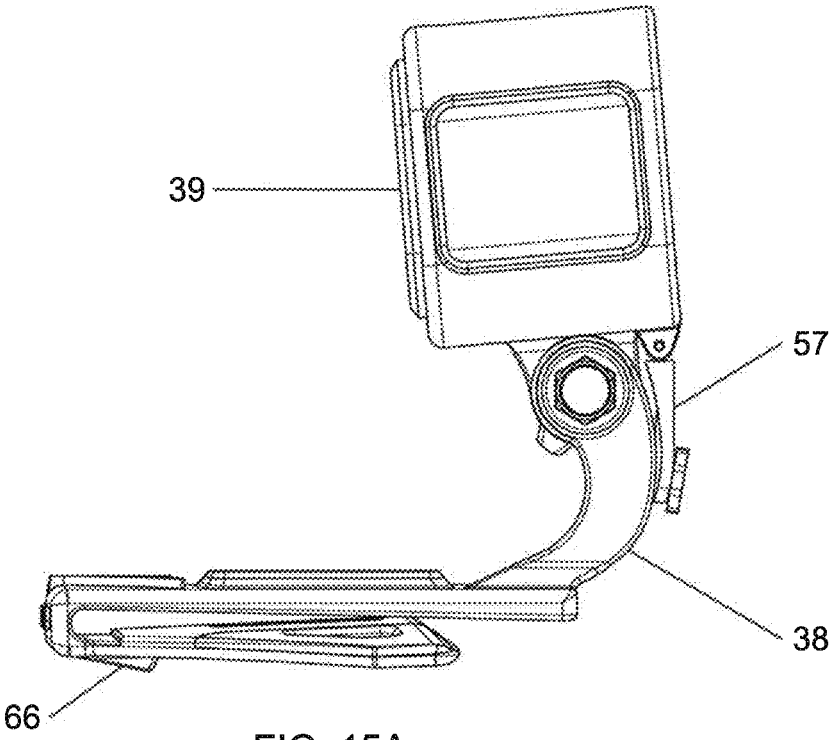
FIGS. 15A and B depict an embodiment of the present invention clip having a device positioning stop that allows the user to establish a preset positioning setting on the clip for a given accessory device for repeatable, quick and easy deployment of the accessory device.
Figure 15B:
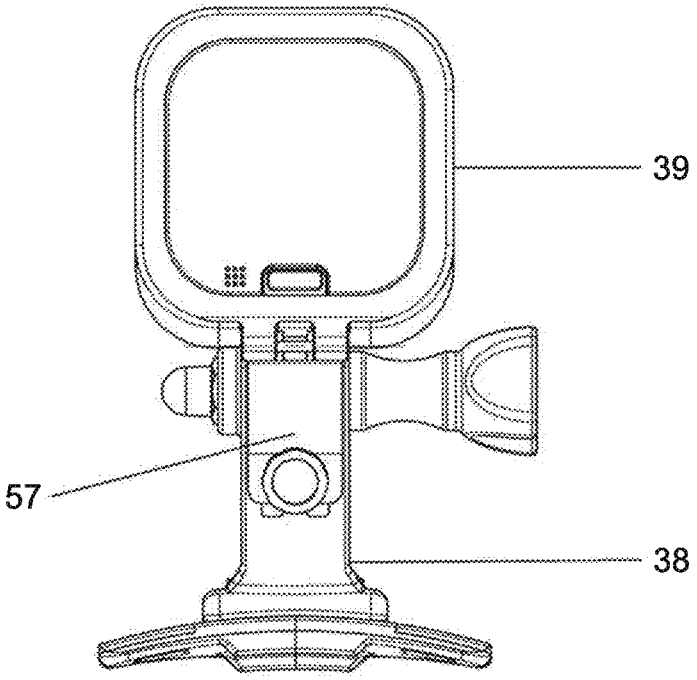
Figure 16:
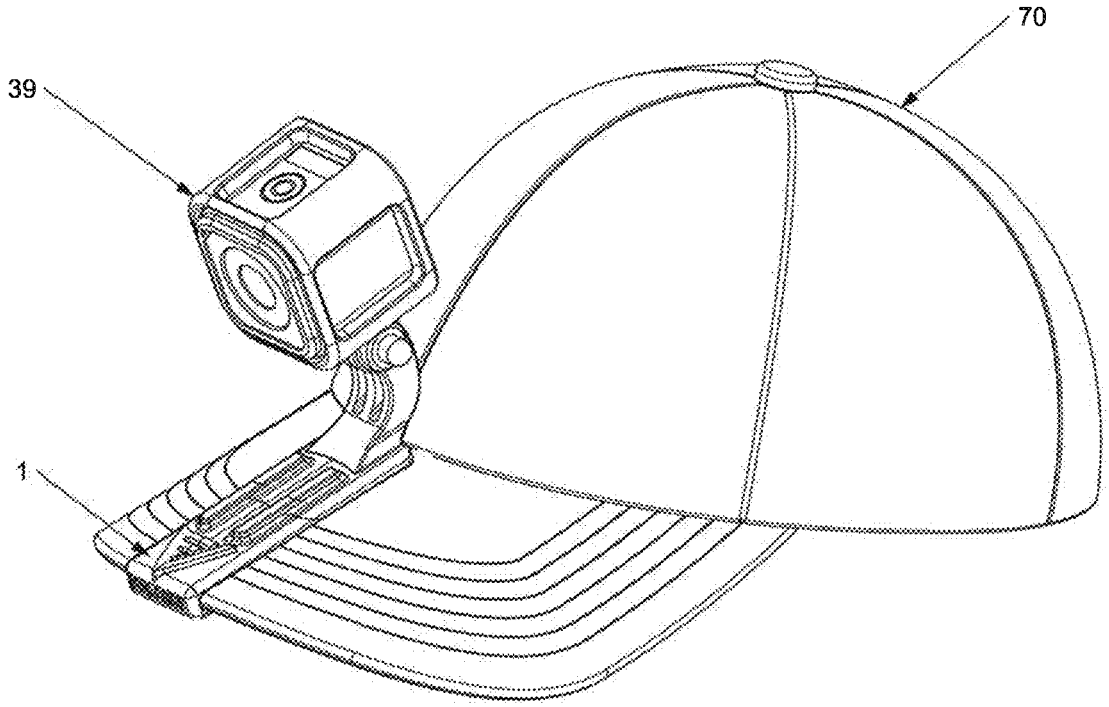
FIG. 16 depicts an embodiment of the present invention clip with a POV camera mounted to it, the clip being attached to a baseball cap.

Users deploying POV cameras on their hats often find it difficult to know if their camera is properly positioned or angled to record the best scene. To remedy this problem clip 1 may include a position stop 57 on or operable with accessory mounting structure 38. Such an alternate embodiment clip is shown in FIGS. 15A and 15B, which show a stop 57 as part of a mounting structure 38 sized and shaped to secure a GoPro brand camera. In operation a user will position stop 57 on mounting structure 38 through trial and error to find the best positioning angle of whatever device (e.g., light or POV camera) 39 he or she is using. Once that optimum positioning angle is determined, the user can then set and fix (preset) stop 57 to the correct location on mounting structure 38. Afterwards, a user can simply mount the selected device 39 to clip 1 and angle the device against stop 57 and be assured that the device in properly angled (according to the usual and customary way the user wears his or her hat) to best capture or illuminate the area in front of the user. Hence, deploying the accessory device on the clip can be performed repeatedly quick and easily.

As shown in the figures, clip 1 may also include a thin (non-obscuring) tab 65. Tab 65 depends from second panel 3 and provides a vertical surface 67 (which may be angled as shown in the figures) upon which a user's thumb or finger can push against to remove clip 1 from brim 70. In a more preferred embodiment, clip 1 may include display tab 66 depending from panel 3. The embodiment clip shown in the figures includes both types of tabs 65 and 66, but the clip could include either tab individually. Tab 66 is designed not limitedly for removal of the clip, but to provide a mechanism by which the user can be alerted to one or more operational statuses of a mounted device. In this embodiment, vertical surface 67 of tab 66 may include one or more indicators (shown by way of example in the embodiment as lights) 68. One or more indicators 68 are part of an electronic receiving circuit (not shown) that is in wireless communication with device 39 (such as via wifi or Bluetooth signaling). The communication between the device and the receiving circuit of display tab 66 allows the one or more indicators to indicate to the user various statuses of the device. Such statuses could include the situation where the device: is recording, not recording or is running low on charge or battery power.

A clip constructed in accordance with the present invention is able to securely retain and position common accessory devices, including the heavier camera and light devices. The clip can be manufactured in a variety of sizes to accommodate different size hat brims. The clip may be made of a plastic, carbon fiber or metal base material. If plastic, the clip is preferably injection molded or 3D-printed from plastic.

The design of the inventive clip described above also has beneficial application as the foundation for a two-piece clip or a clip system that allows for interchangeable attachment of a variety of device mounting structures. In this respect, many accessory device manufacturers utilize distinct mounting supports for their devices. In many cases, these mounting supports are not compatible with other devices. Thus, it would be beneficial to have a clip device that allows for interchanging of mounting supports to allow mounting of these devices from different manufacturers. This can be done via an inventive system in which a clip body includes at its proximal end structure to releasably engage end-pieces allowing for a variety of mounting supports. In the preferred embodiment the clip body substantially meets the design of the above described clip. The components of such an embodiment system are shown in FIGS. 18-26C.

In one embodiment, a system for interchangeable mounting of accessory devices on a hat brim comprises a clip body 401 and one or more end-pieces 490. Clip body 401 comprises a top (first) panel 402 and a bottom (second) panel 403. Top and bottom panels 402, 403 respectively have a length 407, 414, width 408, 415, inner surface 411, 417, outer surface 410, 418 proximal end 406, 413 and distal end 405, 412. Top panel and bottom panel 402, 403 are each resiliently connected at their distal ends to nose segment 404. Nose segment 404 has an outer (front-facing) surface 426 and an inner (brim-facing) surface 427. Bottom panel 403 has a wedge shaped portion 452 in which the width 408 of the panel 403 increases from distal end 412 of panel 403 to proximal end 413 of the panel 403. Clip body 401 may have all of the features described above for clip 1 sans the integral mounting structure 38, which is instead replaced by an attachment mechanism 491 sized and shaped for complementary attachment to an end-piece 490. By having a system including multiple end-pieces 490, each with a mounting post 438 for a different accessory mounting mechanism, the interchangeability of end-pieces 490 allows the clip system to be used for a multitude of accessory devices.

Figure 36:
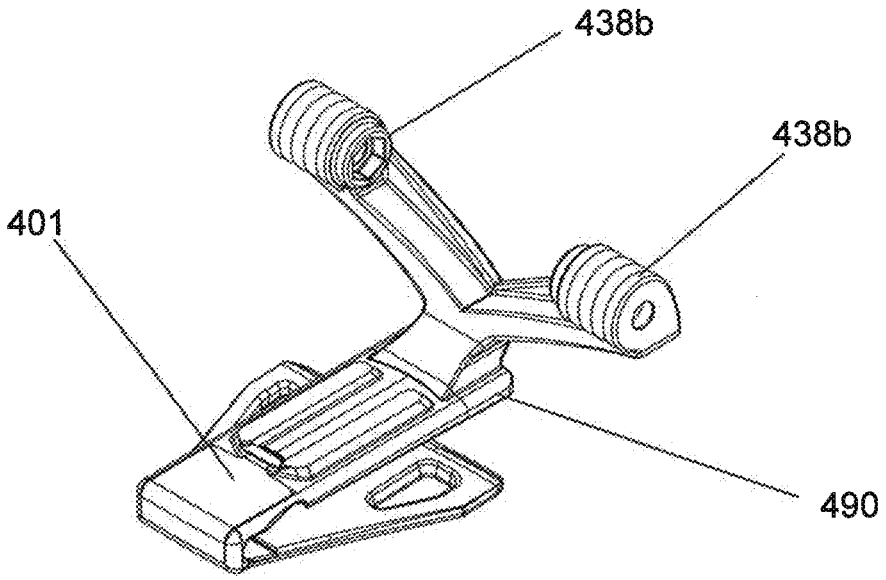
FIG. 36 is a perspective view of an embodiment system showing an end-piece attached to a clip body, the end piece having dual mounting structures.
Figure 37:
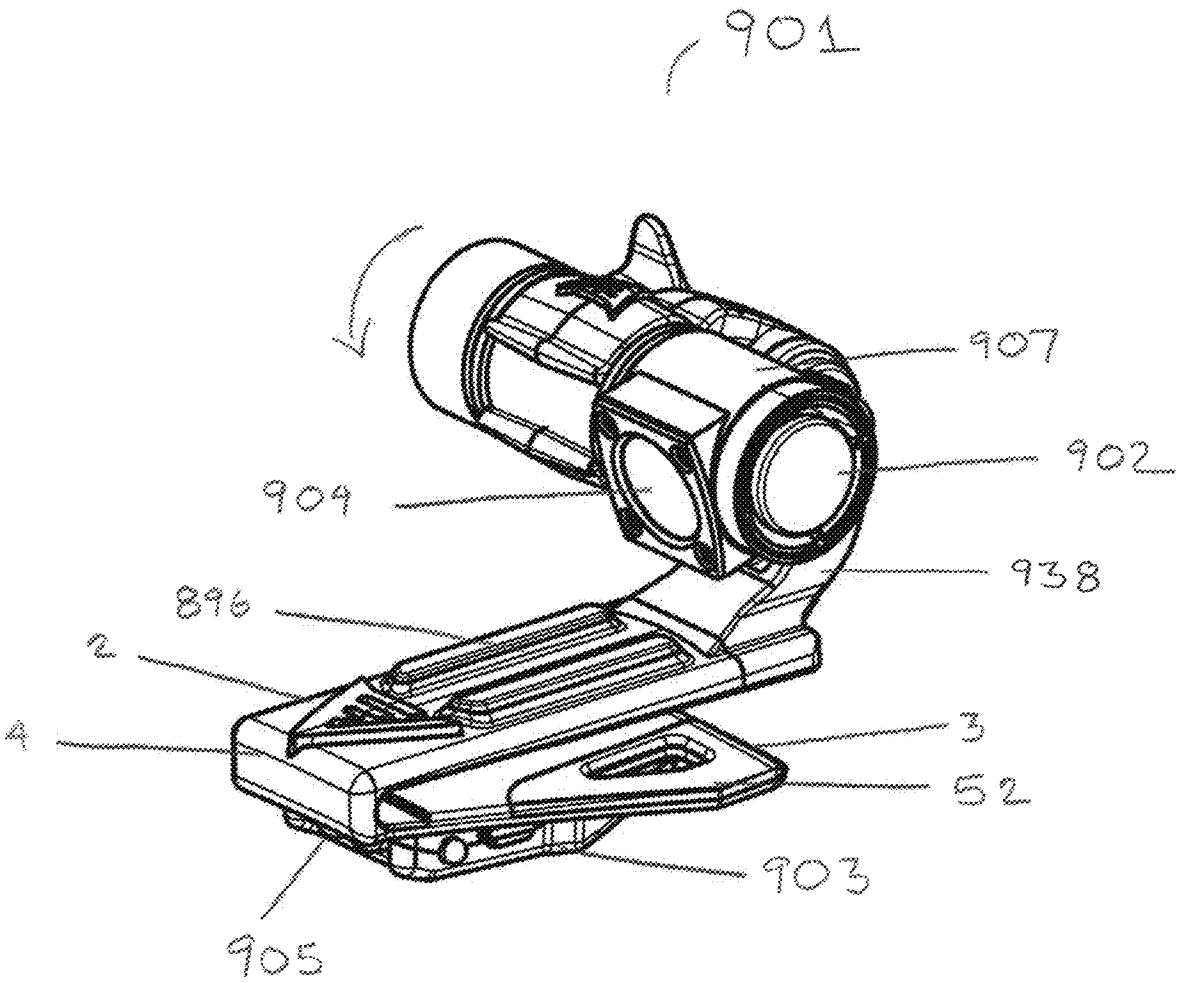
FIG. 37 is a perspective view of an embodiment clip of the disclosed inventive construct having a first light system on the first panel and a second light system on the second panel. First light system is rotatably positionable.
Figure 38:
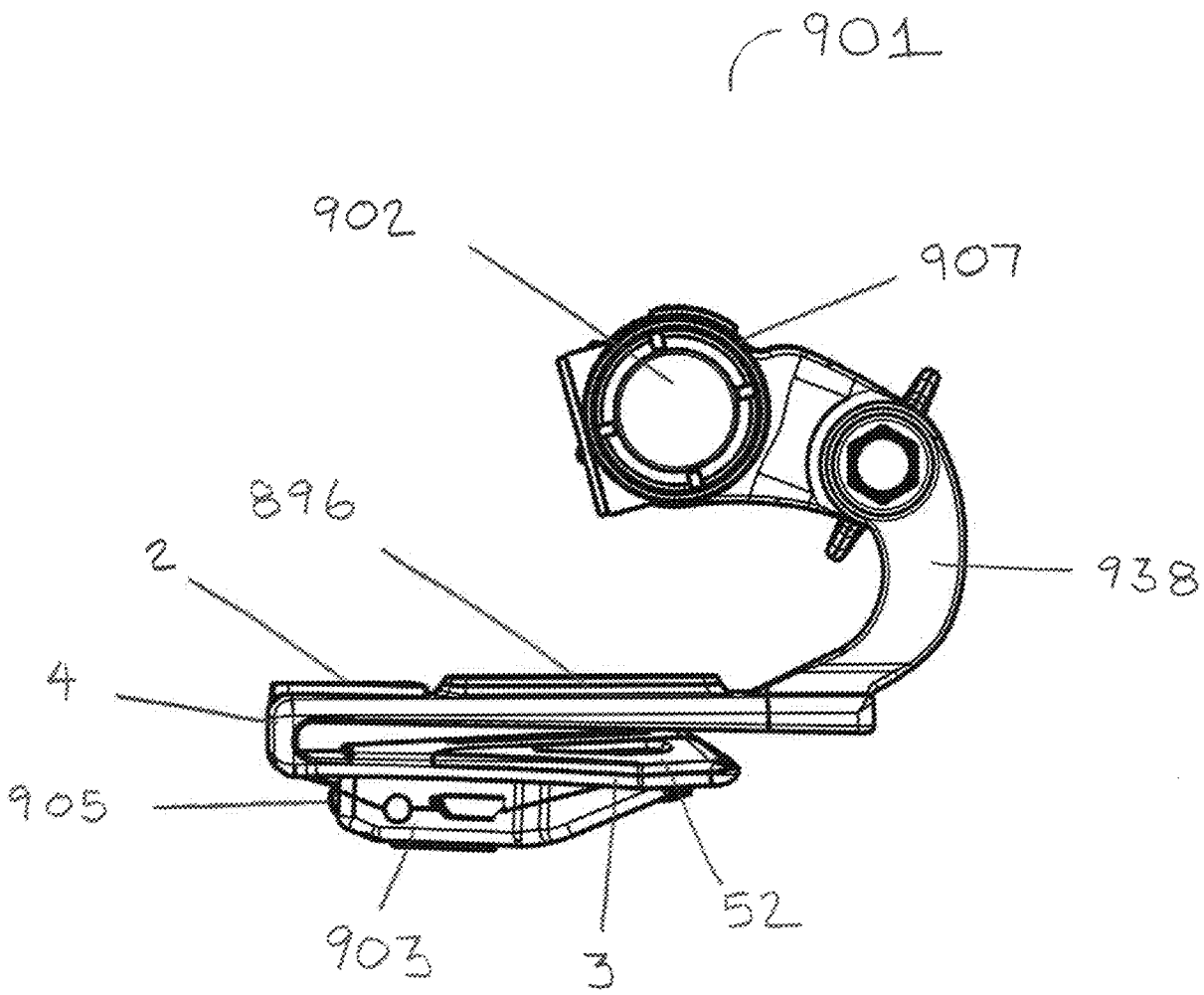
FIG. 38 is a right side elevation view of an embodiment clip of the disclosed inventive construct having a first light system on the first panel and a second light system on the second panel.
Figure 39:
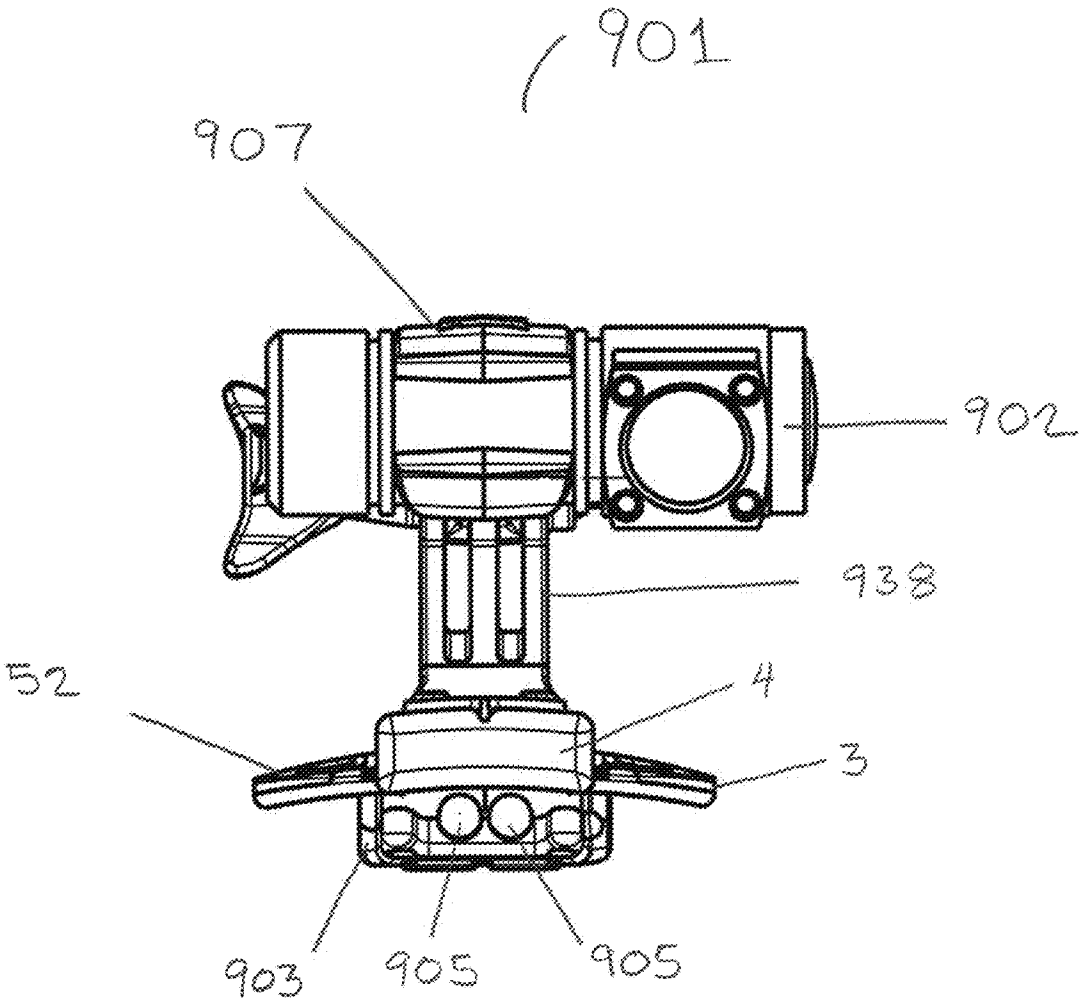
FIG. 39 is a front elevation view of an embodiment clip of the disclosed inventive construct having a first light system on the first panel and a second light system on the second panel.
Figure 40:
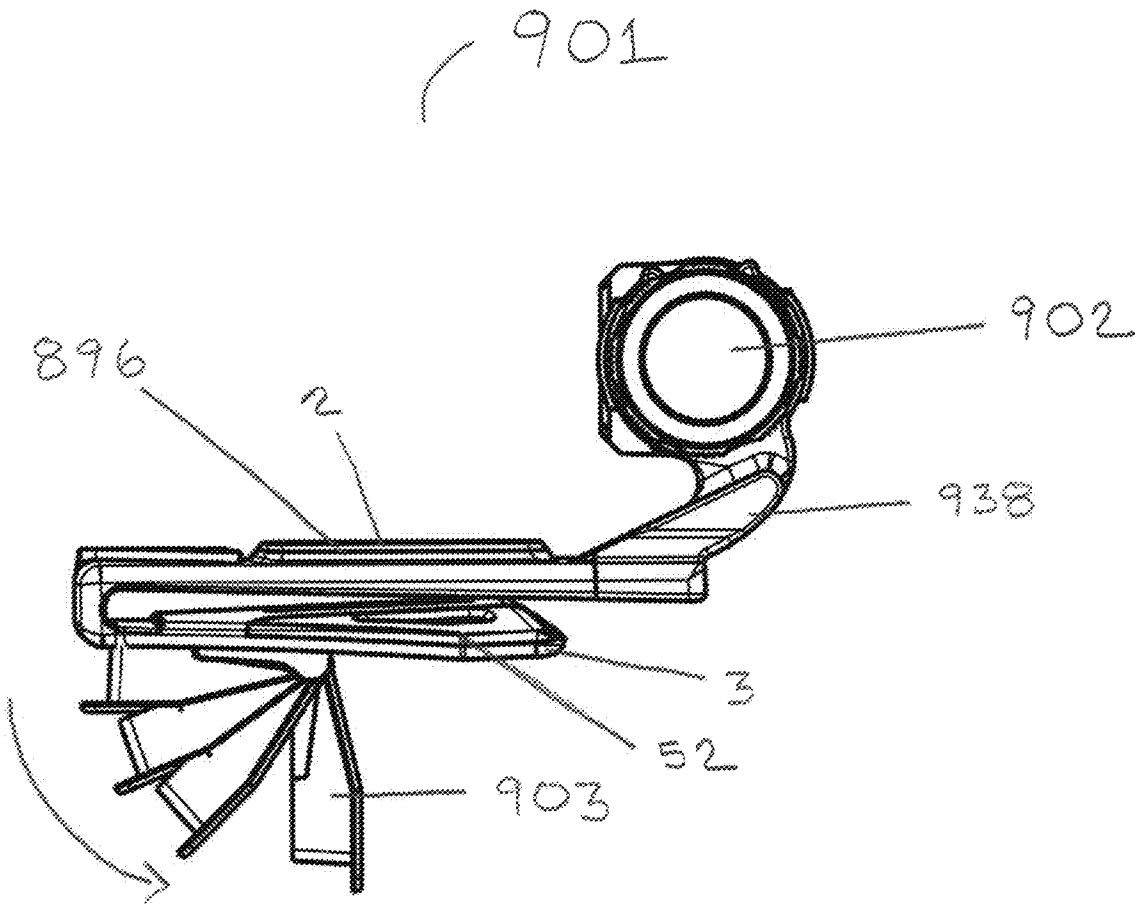
FIG. 40 is a right side elevation view of an embodiment clip of the disclosed inventive construct having a first light system on the first panel of the clip and a second light system on the second panel of the clip. The first light system is rotatably adjustable and the second light system shown being pivotable on the second panel.
Figure 41:
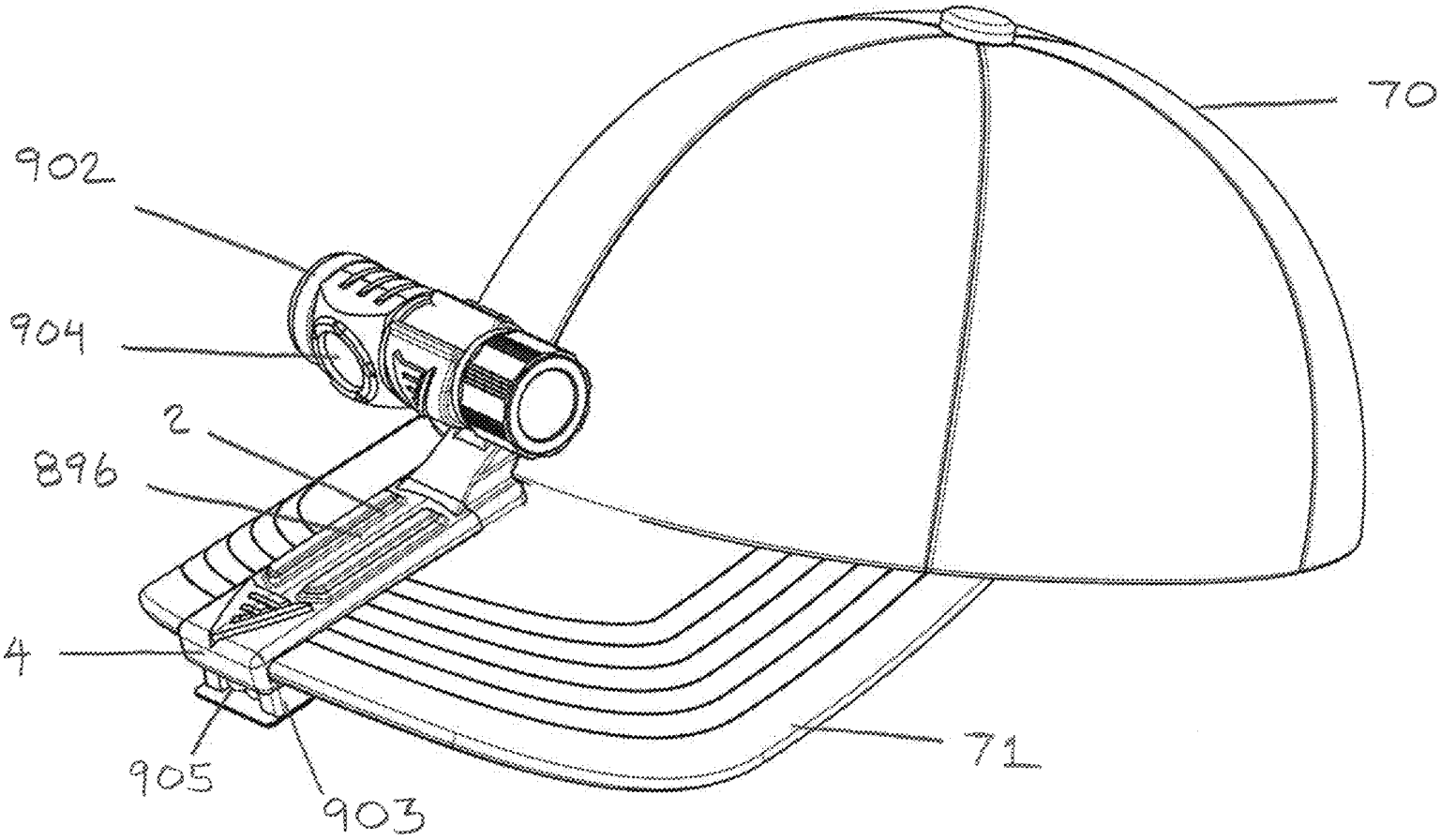
FIG. 41 is a perspective view of an embodiment clip of the disclosed inventive construct having a first light system on the first panel and a second light system on the second panel. The clip is depicted in its deployed position on the brim of a hat.

In the preferred embodiment system, clip body 401 will share many of the structural features as are or may be included on clip 1. In this respect, on clip body 401 the inner (bottom) surface of first panel 402 is concave and the inner (top) surface 418 of second panel 403 is convex. Proximal end 406 of first panel 402 includes a first attachment structure 491. The one or more end-pieces 490 include device mounting structure 438 and a second attachment structure 492 sized and shaped for releasable complementary attachment to first attachment structure 491. Preferable structure for complementary attachment structures 491, 492 include a tongue and slot arrangement, whereby a tongue 493 on clip body 401 frictionally inserts and is engaged by slot 494 on end-piece 490. Such exemplary complementary structure is shown in FIGS. 18-26C. Other types of mechanical engagement methods may be used such as a side release buckle or a slide entry flared bead/undercut track structural arrangement. Mounting structure 438 on end-piece 490 can include a positioning stop allowing a user to preset a position of the accessory device on the clip. By utilizing a system comprising a clip body with interchangeable end pieces, a wider variety of end pieces and mounting structures can be utilized with the system. For example, FIG. 36 shows an embodiment system showing end-piece 490 attached to clip body 401. As seen in this figure, end piece 490 has dual mounting structures 438*a* and 438*b* that allow the clip system to receive multiple lights, multiple cameras or a camera and a light.

Note that the invention is also drawn to the clip body of the immediately described system that allows for interchangeable mounting of accessory devices on a hat brim. The clip body has the physical structures described above, particularly proximal end 406 of top panel 402 including a first attachment structure 491 sized and shaped to releasably attach to a complementary second attachment structure 492 connected to an end-piece 490.

In another embodiment, the design of the present invention clip and also the systems using a similarly structured clip body of FIGS. 18-26C can be adapted to include a mount for holding a microphone/jack. Such an enhanced clip is shown in FIGS. 27-32. As shown in those figures, a clip 501 (or the clip body 401) for mounting accessory devices on a hat brim comprises the same structural elements as the inventive clip 1 described above. Clip 501 thus comprises two panels 502, 503 and can also have one or more of the additive features described above for clip 1. Clip 501 further includes mount 595. Mount 595 is sized and shaped to releasably hold a readily purchasable microphone/jack 596 in wired or wireless electrical communication with an accessory device 539 mounted on the clip.

Microphone/jack mount 595 preferably descends from outer surface 517 of lower (second) panel 503. Mount 595 may be integrally formed in lower panel 503 or panel 503 may be formed to mechanically receive microphone/jack mount 595 such as by providing outer surface 517 with a friction fit receiving hole to receive a post formed in mount 595. Mount 595 could also be attached to lower panel 503 via an adhesive. The wedge-shaped portion 552 of panel 503 (particularly cutout 542) provides an ideal location at which to provide receiving means by which to frictionally engage a microphone/jack mount 595. For example, cutout 542 could itself be the receiving means in which to insert a press-fit, silicone projection attached to microphone/jack 596. Additionally, in some recording situations it is preferable that the microphone/jack 596 point towards the user's face so that the microphone fully captures the user's narration. As shown in the figures, in the depicted embodiment, microphone/jack mount 595 is preferably sized and shaped so as to releasably hold the microphone/jack 596 in a position whereby the microphone/jack 596 points in a direction down and away from the nose segment 504 of the clip 501 (i.e., towards the face of a user wearing the hat on which clip 501 is mounted).

In a more preferred embodiment, clip 501 includes wire-holding means 598 to releasably engage a wire 599 leading from an accessory device 539 mounted on clip 501 to a microphone/jack 596 held by the mount. A preferred wire-holding means 598 is a channel 598*a* integrally formed in the clip. Alternative wire-holding means 598 includes one or more spring clips integrally formed in clip 501.

Figure 30:
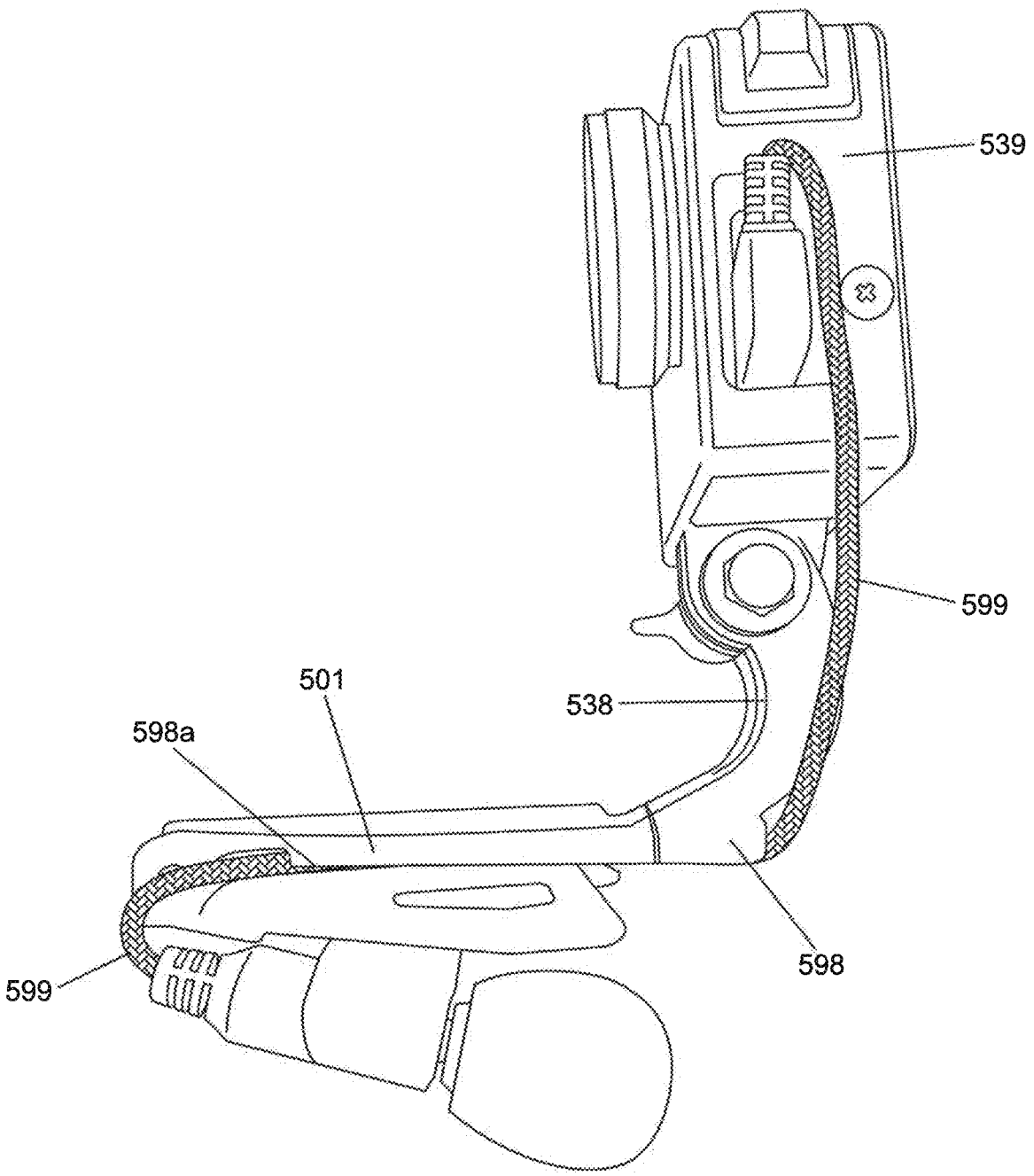
FIG. 30 is a right side elevation view of an alternative embodiment clip including a mount sized and shaped to releasably hold a microphone/jack. The clip in the image is shown with a mounted camera in electrical communication with a mounted microphone. The shown clip includes integral wire-holding means to securely hold a wire leading from a held microphone or microphone jack to a mounted accessory device.
Figure 31:
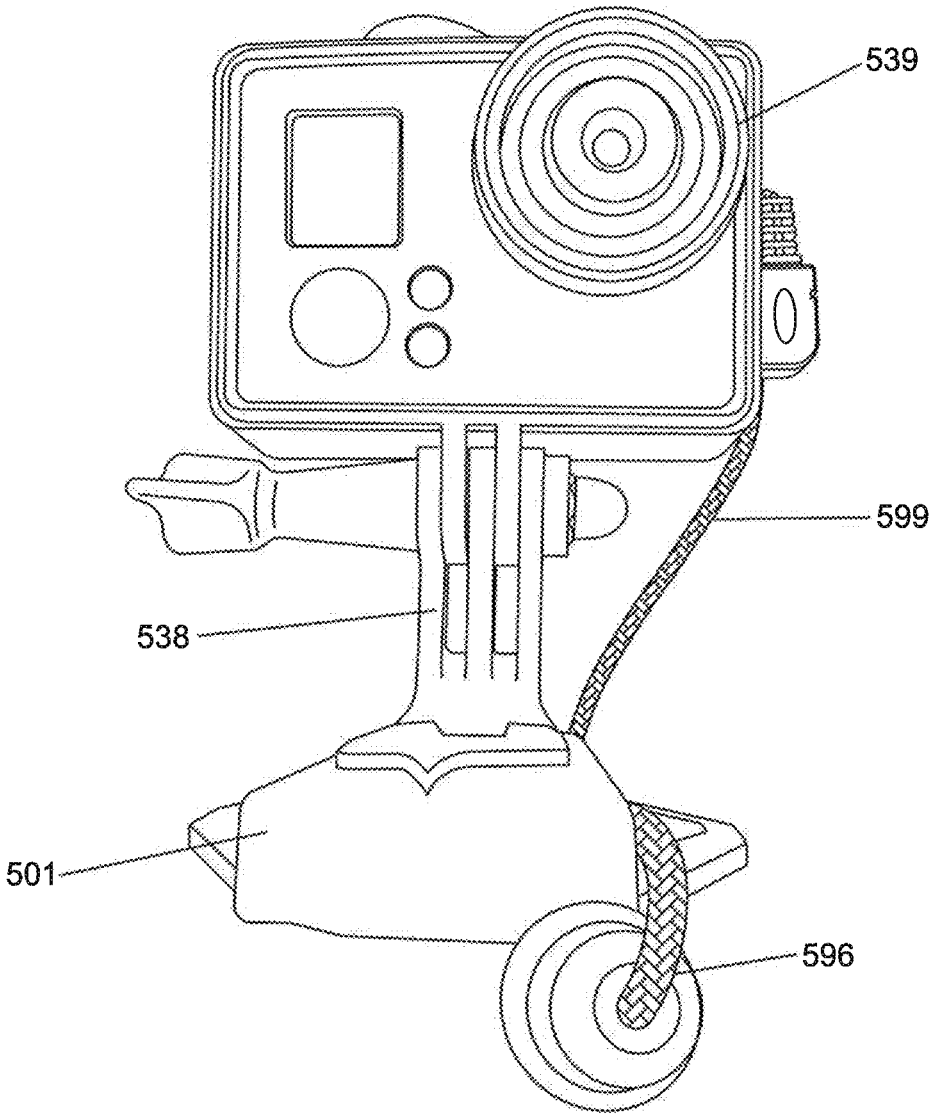
FIG. 31 is a front elevation view of an alternative embodiment clip including a mount sized and shaped to releasably hold a microphone/jack. The clip in the image is shown with a mounted camera in electrical communication with a mounted microphone. The shown clip includes integral wire-holding means to securely hold a wire leading from a held microphone or microphone jack to a mounted accessory device.
Figure 32:
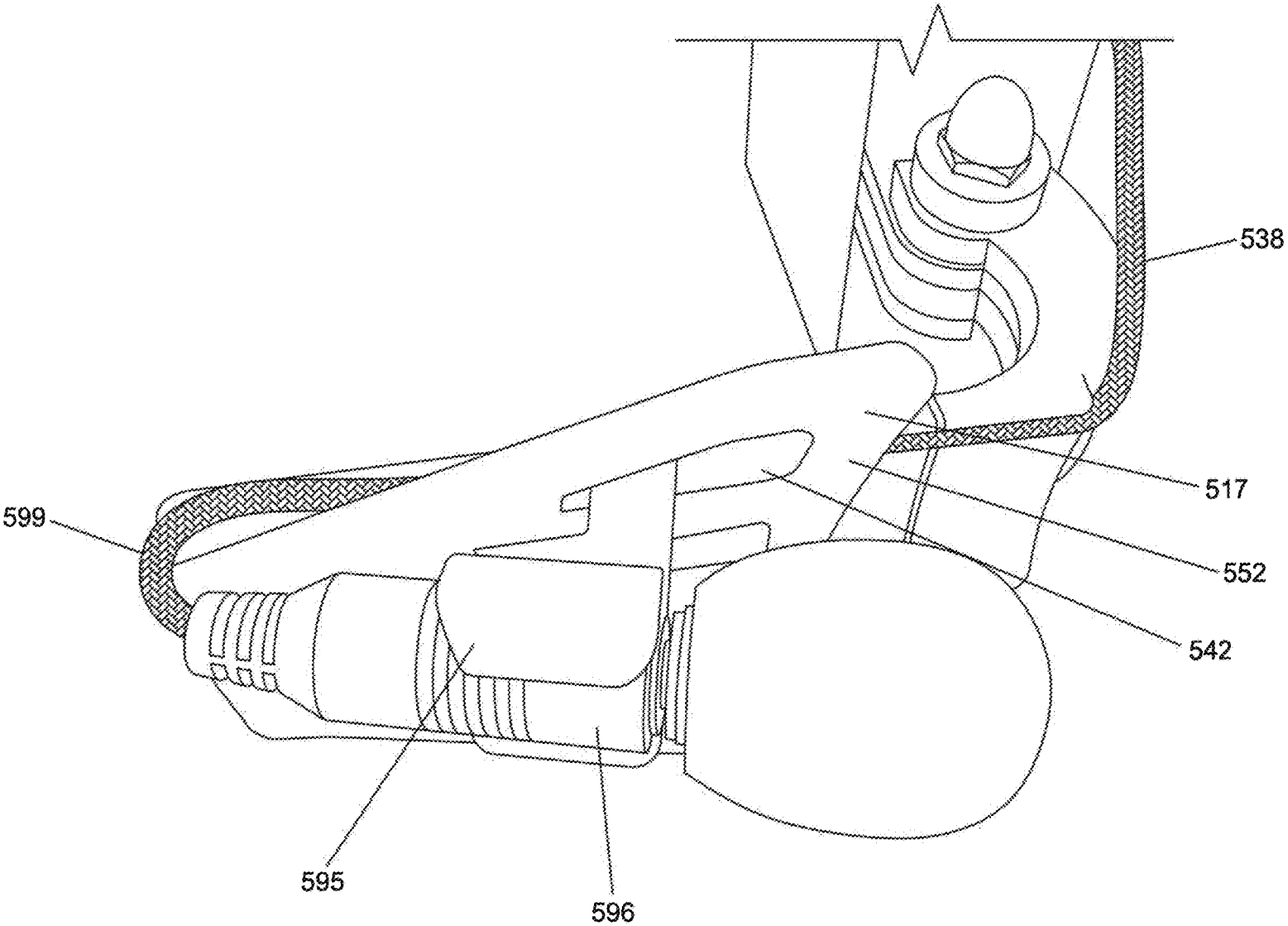
FIG. 32 is a bottom perspective view of an alternative embodiment clip including a mount sized and shaped to releasably hold a microphone/jack. The clip in the image is shown with a mounted camera in electrical communication with a mounted microphone. The shown clip includes integral wire-holding means to securely hold a wire leading from a held microphone or microphone jack to a mounted accessory device.

The microphone/jack mount design works particularly well with arrangements that include a microphone cable 599 that can interface with the mini USB connection on a camera. An appropriate length cable 599 is one that extends from a device 539 mounted at the proximal end of clip 501, along the length of clip 501 and on to the lower surface 517 of bottom panel 503. Cable 503 may be directly connected to a microphone/jack 596. As seen in the figures, after cable 599 descends from the accessory device (camera) 539, cable 599 threads through clip 501 through integrated wire holding mechanism 598. This is best seen in FIG. 30 in which integrated wire holding mechanism 598 is embodied as channel 598*a*. This design leads to a fully and direct integration of a microphone with the hat clip for a lower profile and weight reducing option. The integrated wire holding means 598 means that any wire between device 539 and microphone/jack 596 follows the contour of clip 501 in close proximity to clip 501 and thus is particularly beneficial in reducing dangling cable or cable slack that can be snagged by external structure such as leaves, branches or other projecting elements.

Figure 29:
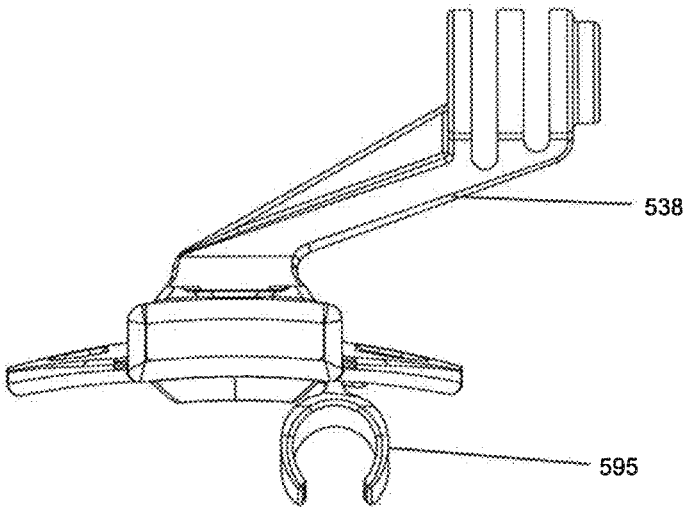
FIG. 29 is a front elevation view of an alternative embodiment clip including a mount sized and shaped to releasably hold a microphone/jack in electrical communication with an accessory device mounted to the clip and that has an offset accessory device mounting structure.

As shown in the figures, microphone/jack mount 595 is preferably in the form of a two-prong spring clip allowing the microphone/jack 596 to be press fit into the clip and retained. FIG. 29 is a front elevation view of an alternative embodiment clip 501 including a mount 595 adapted to releasably hold a microphone/jack in electrical communication with an accessory device mounted to the clip. Clip 501 of FIG. 29 has an offset device mounting structure 538.

Figure 33:
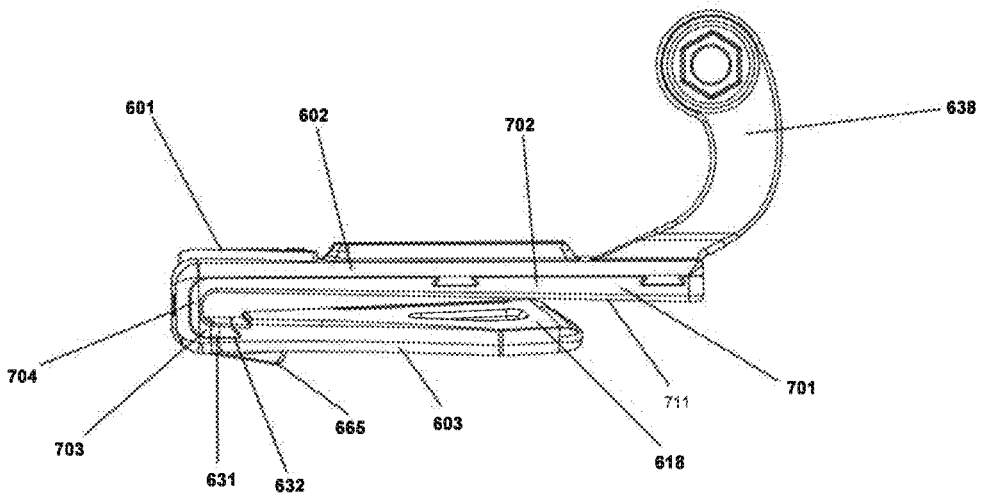
FIG. 33 is a right side view of an embodiment of a present invention system utilizing a clip body and one or more panel inserts to accommodate brims of varying thicknesses.
Figure 34A:
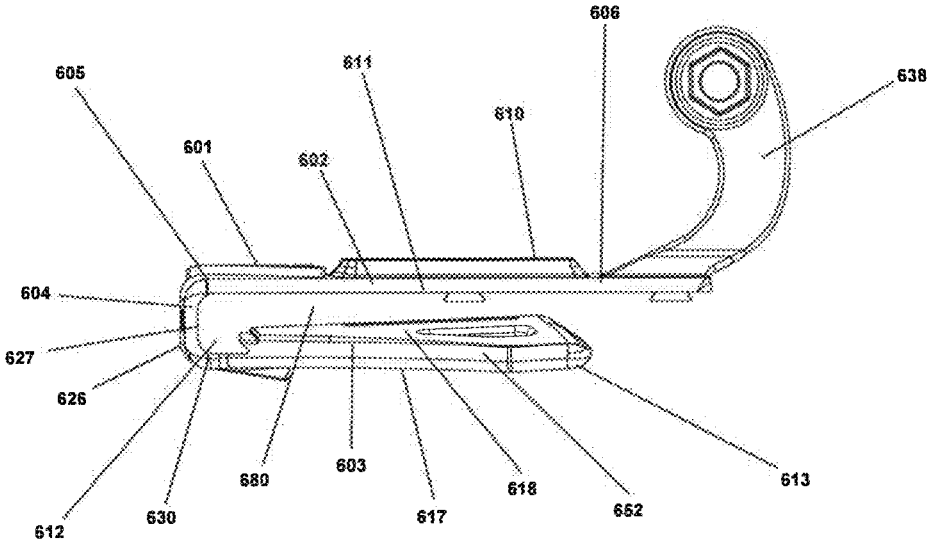
FIG. 34A is a right side view of an embodiment of a clip body (with the panel insert removed) of the embodiment present invention system of FIG. 33 that accommodates brims of varying thicknesses.
Figure 34B:
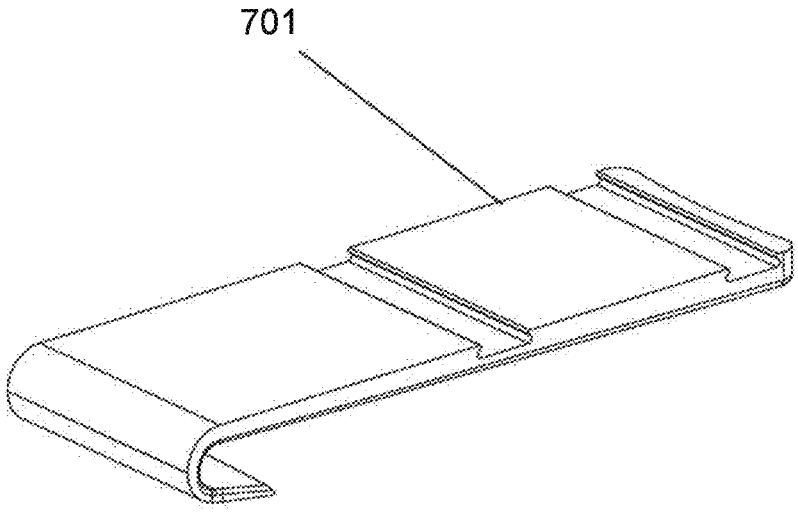
FIG. 34B is a perspective view of an embodiment insert.

The design of the inventive clip 1 described above also has beneficial application as part of a clip system that allows for attachment of accessory devices to brims of varying thicknesses. An embodiment of such a system is shown in FIGS. 33, 34A and 34B. In this respect, though the clip described above has shown to have good application on the common brim thicknesses found on commercially available baseball caps, the variance in brim thicknesses can affect the purchase of clip 1 on the brim. Thus, it would be beneficial to have a way to adjust the height of the spacing 80 defined by the top and bottom panels of the clip. This can be done via an inventive system in which a clip body 601 meeting the design of the above described clip 1 releasably engages an insert 701 that can be used to vary the vertical spacing 680 between top and bottom panels 602, 603 of clip body 601. Insert 701 can be sized and shaped so as to engage and cover either or both of panels 602, 603. The system can include one or more interchangeable inserts 701 of varying thicknesses, textures and size.

An embodiment system for mounting accessory devices on a hat brim is depicted in FIGS. 33-34B. Such an embodiment system comprises clip body 601 and one or more inserts 701. Clip body 601 comprises a top body panel 602 and a bottom body panel 603. Top body panel 602 and bottom body panel 603 respectively have a length and a width akin to that of clip 1. As shown in FIGS. 33 and 34A, top body panel 602 and bottom body panel 603 respectively have an inner surface 611, 618, an outer surface, 610, 617, a proximal end 606, 613 and a distal end 605, 612. Top body panel 602 and bottom body panel 603 are each connected at their distal ends 605, 612 to a body nose segment 604.

Body nose segment 604 has an inner surface 627 and an outer surface 626. Bottom body panel 603 has a wedge shaped portion 652 in which the width of bottom body panel 603 increases from distal end 612 of panel 603 to proximal end 613 of the panel. As with clip 1, the width of body bottom panel 603 at its proximal end 613 is preferably 1.5 to 2.5 times the width of top body panel 602 at its proximal end 606. Inner surface 611 of top body panel 602 is preferably concave. Inner surface 618 of bottom body panel 603 is convex. Outer surface 610 of top body panel 602 at proximal end 606 of top body panel 602 includes mounting structure 638 sized and shaped for receiving an accessory device such as a camera or light.

As best seen in FIG. 34B insert 701 includes an insert first panel 702. Insert 701 is sized and shaped so as to be received by clip body 601 whereby insert 701 is engaged by and contacts one of the panels of clip body 601 to reduce the intra-panel spacing 680 of clip body 601. In the depicted embodiment, insert first panel 702 of insert 701 is releasably engaged by clip body 601 and insert first panel 702 contacts inner surface 611 of top body panel 602. Preferably, insert 701 will contact all or a majority of an inner surface of clip body 601 (inner surface 611 of top body panel 602 in the depicted embodiment). Generally, the more surface of clip body 601 that insert 701 covers, the better the fabric gripping ability. In one embodiment, insert 701 is made from the same material as clip body 601. In another embodiment, insert 701 is made from a softer more resilient plastic or rubber material than is clip body 601. Inner surface 711 of insert 701 may be texturized to improve brim-gripping ability.

As noted above, insert 701 can be sized and shaped so as to engage and cover either or both of panels 602, 603. In an enhanced system embodiment shown in the figures, insert 701 further includes insert nose segment 704 connected to insert first panel 702. Nose segment 704 is sized and shaped such that when insert 701 is received by clip body 601, insert nose segment 704 contacts inner surface 627 of nose segment 604 of clip body 601. Bottom body panel 603 may include a channel 630 proximate to the connection point between the body nose segment 604 and the bottom body panel 603. In the embodiment depicted in FIGS. 33-34B, insert 701 is sized and shaped to cover and engage top panel 602 and contact inner surface 627 of nose segment 604, while having a short segment 703 that is received by channel 630 on lower panel 603. This is not meant to be limiting as the invention is broadly directed to a system comprising a clip and insert that reduces the spacing between the two panels of the clip. As in the case of clip 1, channel 630 of clip body 601 can include a floor 631. The floor of channel 630 is preferably convex. Channel 630 also preferably includes a sidewall 632 which is convex.

In an alternative embodiment, insert 701 could comprise a top insert panel and bottom insert panel. The two panels could be integrally connected through a nose section or could be separate pieces. In such an arrangement, the system would comprise a clip body as described above and a top insert panel (which would look like panel 702) and a bottom insert panel sized and shaped so as to be releasably engaged by lower panel 603 of clip body 601. The bottom insert panel contacts inner surface 618 of bottom body panel 603. Preferably, insert 701 will contact all or a majority of inner surface 611 of top body panel 602. This system may include an insert nose segment (such as nose segment 704) connecting top insert panel 702 to the bottom insert panel. Insert nose segment 704 is sized and shaped such that when top insert panel 702 and the bottom insert panel are releasably engaged by clip body 601, insert nose segment 704 contacts inner surface 627 of body nose segment 604. Top insert panel 702 and the bottom insert panel have respective inner surfaces, which may be texturized. The distal end of the bottom insert panel can include a channel as described above for clip 1.

The systems described above may include the above-described positioning stop (not shown in FIGS. 33-34B) that allows a user to preset a position of the accessory device on the clip. The systems may also include a tab 665, microphone/jack mount 595 or both depending from bottom body panel 603. Tab 665 may be structured as described above for clip 1.

Figure 35:
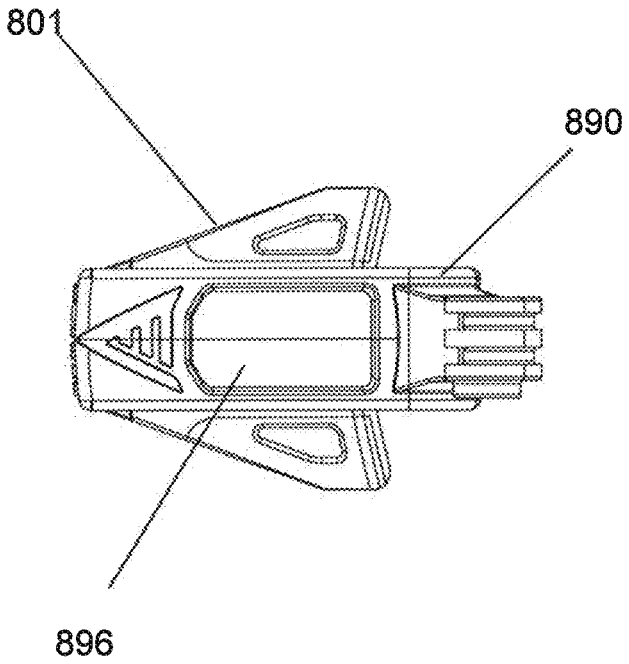
FIG. 35 is a top plan view of an embodiment of a clip system including a body with adjoined end piece. The clip body includes battery compartment.

In an alternative embodiment, any of the clip or clip bodies described herein can include a battery compartment to hold a battery that can power either or both of the indicators mentioned herein or the accessory mounted on the clip. In this respect, FIG. 35 is a top plan view of an embodiment of a clip system including a body 801 with adjoined end piece 890. The clip body includes battery compartment 896, which is sized and shaped to hold a battery. In the case where the battery powers the indicators on the clip or clip body, compartment 896 would include electric wires or conduit to achieve electrical communication between batteries held in compartment 896 and the indicators. In the case where the battery powers the accessory on the clip or clip system, compartment 896 would include electric wires or conduit leading to a plug-in point that would allow the accessory to plug into and be supplied by the battery source held in compartment 896.

The brim-holding design of the inventive clip 1, clip body 401 (or system utilizing clip body 401) described above also have beneficial application in providing for a brim clip having dual light systems 901. This allows the brim clip 901 to provide for dual lighting, which is not available in the market today. Preferred embodiments of brim clip 901 with dual lighting systems is shown in FIGS. 37-43. In basic description, the first (top) panel of clip 901 holds a first light system 902 that includes one or more first light emitters 904. First light system 902 preferably casts a beam in the nature of a utile flash light, particularly one using currently available high-intensity LEDs. Second panel 3 of the clip 901 holds second light system 903 that includes one or more second light emitters 905, which preferably are LEDs. The housings for first and second light systems 902, 903 can be integrally formed into clip 1 or clip body 401 or the light systems can be mechanically attached to the clip or clip body. By combining two beam types, the embodiment clip 901 can illuminate both distance, and close proximity—without having to use hands to hold either light. The light emission is thus controlled by two separate sources 902, 903 and can be directed to two separate locations. In a preferred embodiment, first light system 902 or its one or more first light emitters 904 are pivotable or rotatable so as to be capable of being directed. Similarly, second light system 903 or its one or more second light emitters 905 are pivotable from second panel 3 so it can be directed upwardly and downwardly in relation to a user's hat brim.

Clip 901 can include one or more battery compartments 896 that holds batteries in electrical communication with either or both of first light system 902 and second light system 903. The advantageous construction of clip 901 (or clip body 401) allows for the placement of battery compartments 896 on either or both of first panel 2, 402 or second panel 3, 403. First light system 902 can be integrally formed to clip 901 as shown in FIG. 43 or can be a commercially available flashlight held in light holder 907 as shown in FIGS. 37-42. Using the inventive brim holding structure, clip 901 holds two separate light sources 902, 903 on the same device. Each light source 902, 903 is able to be independently positioned and operated independently such that their light emissions achieve different goals. For instance, the light from second light system 903 would be capable of a lower lumen level than that of first light system 902 so that it can be focused on items of close proximity, such as for reading or detail work. The light from first light system 902 can be focused on distance and has higher lumen content. Additionally, either light system can 902, 903 include a strobe to aid in emergency location.

To improve close proximity usage, second light system 903 or one of its lights 905 can be pivoted in relation to second panel 3 from which it depends. An exemplary pivot range would be 120 degrees. In the preferred embodiment, second light system 903, particularly with pivoting capability, provides an adjustable lighting device that allows a user to read or work with his or her hands at close range or speak to another party without blinding them. Both light systems can be used simultaneously. In this respect, when first light system 902 is activated, close range illumination can be maintained, while at the same time the user can see his or her surroundings. In the preferred embodiment, high intensity LEDs can supply the light for first light system 902 and less intense LEDs, in white or other colors, can supply the light for the second light system 903. The embodiment clip 901 with dual light systems would have particular applicability for hikers that may need to read maps up close, yet still be able to navigate and see dark surroundings. Fishermen would also benefit from the device as the dual light system would allow them to do close proximity work like tying lures and flies and have their surrounding lit for purposes of casting. Hikers and hunters could use the dual light system of the clip as they navigate through wooded areas to see both near structure and distant structure. One working on a car at night could use the embodiment clip to work on a car without additional outside lighting. In this case, the second light system could illuminate instructions and the first light system could illuminate the engine compartment.

In more specific description the brim clip 901 with dual light system 902, 903 is a clip for mounting on a hat brim. A preferred embodiment of this clip 901 comprises a first panel 2 and a second panel 3, the first and second panels respectively having a length 7, 14, width 8, 15, top surface 10, 18, bottom surface 11, 17, proximal end 6, 13 and distal end 5, 12 as discussed above with respect to FIGS. 1-10 and 13A-17. First panel 2 and second panel 3 are resiliently connected at their distal ends 5, 12 to a nose segment 4. Second panel 3 has a wedge-shaped portion 52 in which the width of wedge-shaped portion 52 increases from distal end 12 of panel 3 toward proximal end 13 of panel 3. Nose segment 4 preferably has the features described above in relation to the basic inventive brim clip. First light system 902 is connected to the first panel 2. First light system 902 has at least one first light emitter 904. Second light system 903 depends from second panel 3. Second light system 903 has at least one second light emitter 905. The at least one first light emitter 904 and the at least one second light emitter 905 preferably emit light of different intensities.

In one embodiment, the clip 901 with dual lighting systems includes one or more battery-holding compartments 896 depicted previously. Compartment 896 is sized and shaped to hold one or more batteries and place the batteries in electrical communication with either or both of the first light system 902 and second system 903. Each light system could be energized by batteries held in a compartment dedicated to that light system or the clip could have one or more compartments that energize both light systems. Batteries energizing either or both light systems can be rechargeable batteries, in which case the clip could have a charging interface allowing charging of the installed one or more batteries. In another embodiment, the first light system 902 is held by a light holder 907 and the top surface 10 of first panel 2 at its proximal end 6 includes structure 938 that connects to light holder 907. This last embodiment enables the clip to hold and deploy a variety of aftermarket flashlights. Alternatively, as shown in FIG. 43, structure 938 may hold integrated light system 902. In a more preferred embodiment, second light system 903 or the at least one second light emitter 905 is pivotable from second panel 3. Similarly, first light system 902 or the at least one first light emitter 904 is pivotable. In an alternate embodiment, the first light system can include a strobe light. As shown in the figures, clip 901 holds first light system 902 at proximal end of panel 2.

Figure 42:
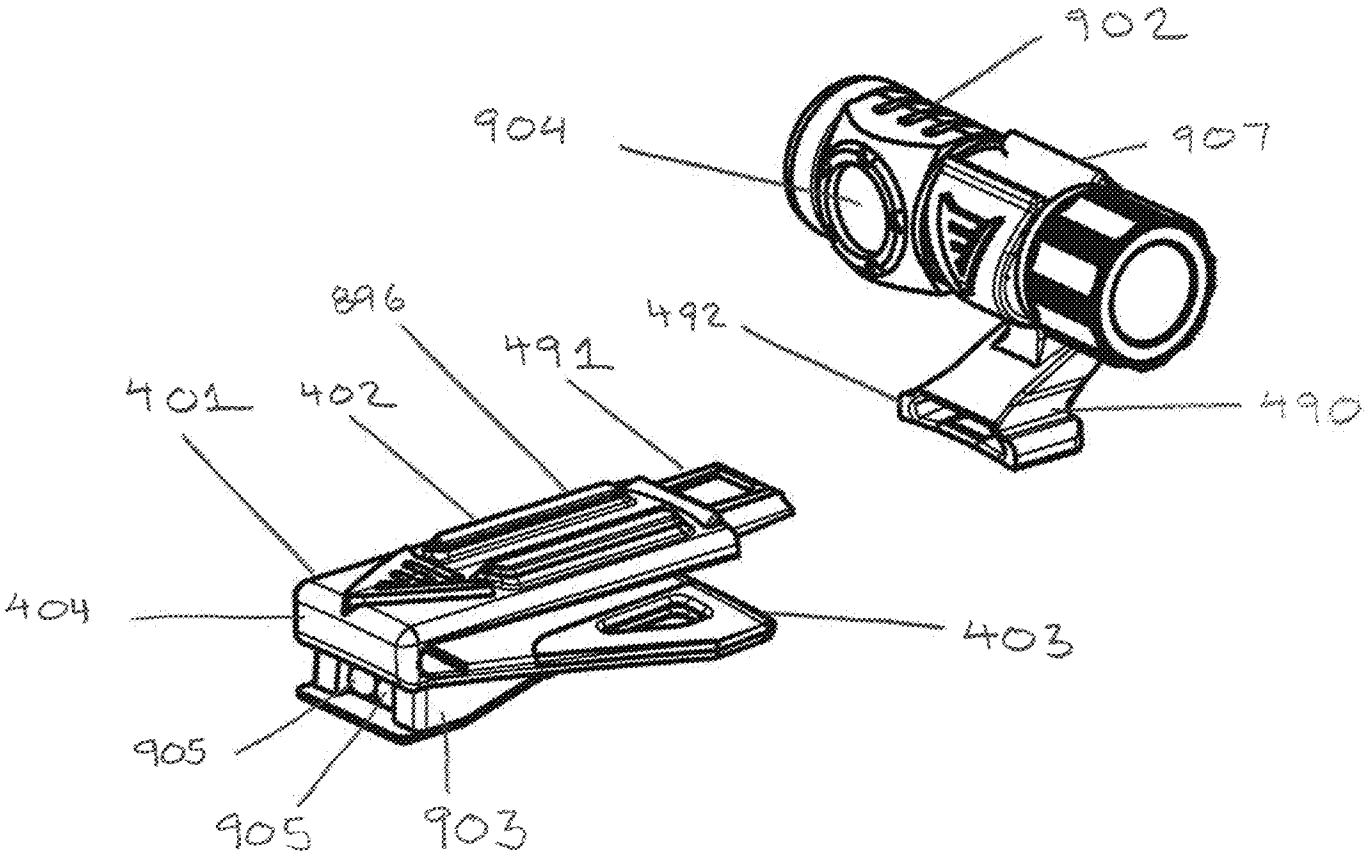
FIG. 42 is a front perspective view of an embodiment system having the dual lamp feature described herein. The system comprises a clip body and an end-piece. The end-piece has a first light system and the second panel of the clip body includes the second light system.
Figure 43:
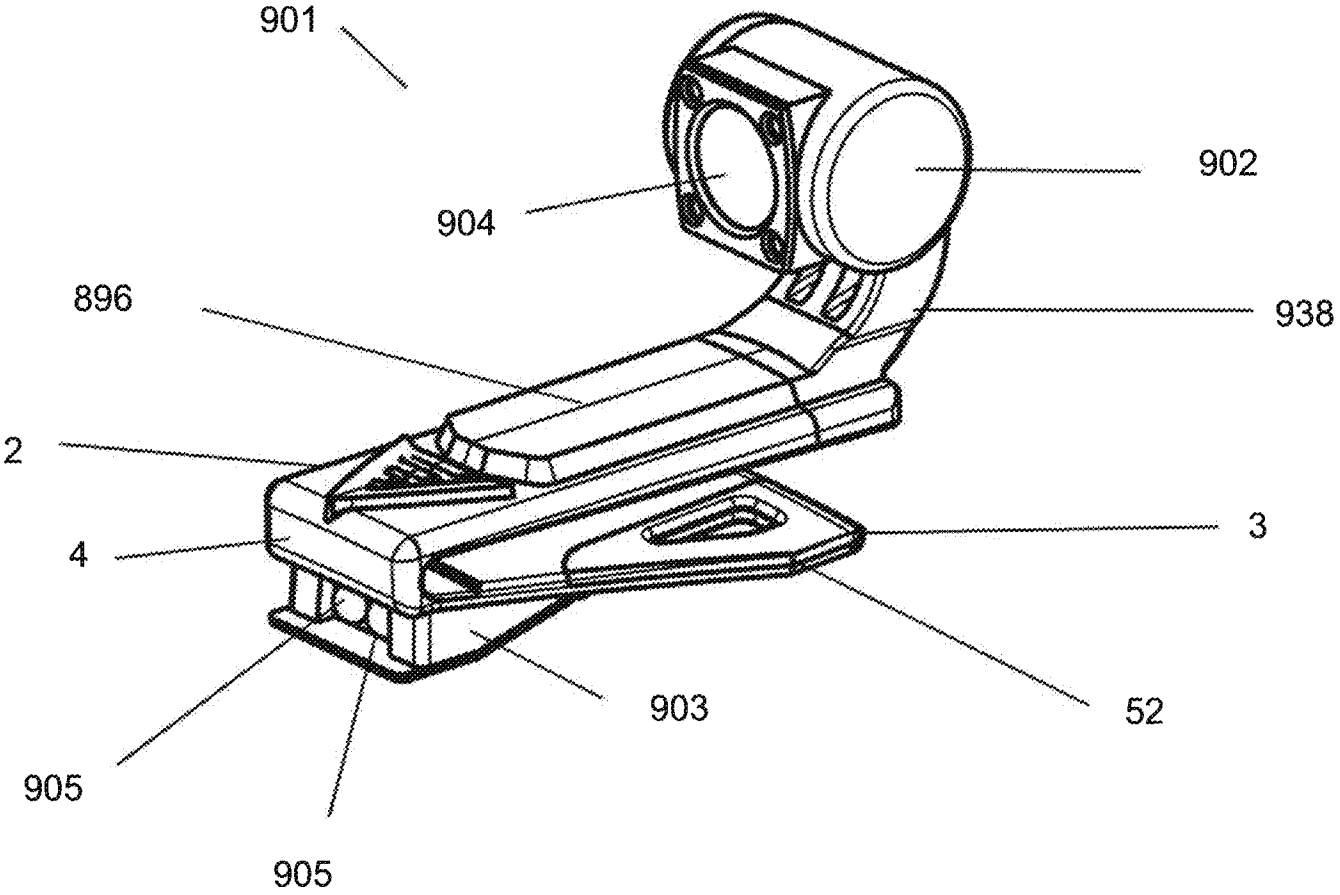
FIG. 43 is a front perspective view of an embodiment brim clip having a first light system on the first panel and a second light system on the second panel. The first light system is integrally formed into the clip as opposed to being a deployed after-market light.

FIG. 42 depicts an embodiment invention in the form of a system comprising clip body 401 and one or more interchangeable end pieces 490. The features of clip body 401 match those of clip 1 except that clip body has structure for interchangeable end-pieces. In this regard, clip body 401 comprises a top (first) panel 402 and a bottom (second) panel 403. Top and bottom panels 402, 403 respectively have a length 407, 414, width 408, 415, inner surface 411, 417, outer surface 410, 418 proximal end 406, 413 and distal end 405, 412 as shown in FIGS. 18-26C and described above. Top panel and bottom panel 402, 403 are each resiliently connected at their distal ends to nose segment 404. Nose segment 404 has an outer (front-facing) surface 426 and an inner (brim-facing) surface 427. Bottom panel 403 has a wedge shaped portion 452 in which the width 408 of the panel 403 increases from distal end 412 of panel 403 to proximal end 413 of the panel 403. Clip body 401 may have all of the features described above for clip 1 sans the integral mounting structure 38, which is instead replaced by an attachment mechanism 491 sized and shaped for complementary attachment to an end-piece 490. The clip body 401 has the physical structures described above, particularly proximal end 406 of top panel 402 including a first attachment structure 491 sized and shaped to releasably attach to a complementary second attachment structure 492 connected to one or more end-pieces 490. In this embodiment, battery compartment 896 would include electric wires or conduit to achieve electrical communication between a battery or batteries held in compartment 896 and first and second lighting systems 902, 903. The connection between attachment structures 491, 492 provides electrical continuity so that a battery or batteries housed in compartment would power first light system 902. In the case where the battery powers the accessory on the clip or clip system, compartment 896 would include electric wires or conduit leading to a plug-in point that would allow the accessory to plug into and be supplied by the battery source held in compartment 896. The invention is also directed to the inventive clip body 401 accepting end-pieces to create a clip having the dual light systems 902, 903 discussed above. Clip body 401 with depending second light system can be deployed on a brim without having to attach end-piece 490 to it.

As in the case of the inventive clip, clip system or clip body, the bottom surface of first panel 2 is preferably concave, top surface 18 of second panel 3 is preferably convex and texturized. Brim facing surface 27 of nose segment 4 is preferably concave. It is also preferable that distal end 12 of second panel 3 includes a channel 30 in the top 18 surface of second panel 3 and that channel 30 has a floor 31 and a sidewall 32. Similarly, it is preferable that the wedge-shaped portion 52 of second panel 3 is formed by a pair of flaring side segments 21, wherein each of which connects to a distal segment 22 at an obtuse angle. The inventive dual lamp brim clip 901 can be formed from the clip body 401 described above utilizing an end piece 490 carrying the first light system 902. Similarly, the dual lamp brim clip 901 can be formed in the manner of the brim clip utilizing the insert 701 described previously. Either the clip 1 or clip body 401 can include the tab 66 described above to provide control (including wireless control, such as, but not limited to, Bluetooth) over either or both of first light system 902 or second light system 903. A display on tab 66 could provide indicators 68 indicating the operating condition (e.g., on, off, intensity, number of light emitters operating, battery charge level) of the lighting systems. The inventive clip and clip body can include a microphone or voice pickup module electronically coupled to a processor to allow voice command operation of either of the light systems.

While the embodiments of the method and system of the present invention have been described herein, numerous modifications, alterations and changes to the described embodiments are possible without departing from the scope of the invention. The embodiments described herein are not intended to be limiting. In particular the various enhancements such as the microphone mounting feature, the interchangeable device mounting structure and the interchangeable sizing insert can be incorporated separately or additively with the various described embodiments.

The invention claimed is:

1. A clip for mounting on a hat brim, the clip comprising:

a first panel and a second panel, the first and second panels respectively having a length, width, top surface, bottom surface, proximal end and distal end;

the first panel and second panel each resiliently connected at their distal ends to a nose segment;

the second panel having a wedge-shaped portion in which the width of the wedge-shaped portion increases from the distal end of the panel toward the proximal end of the panel;

a first light system connected to the first panel, the first light system having at least one first light emitter; and a second light system depending from the second panel, the second light system having at least one second light emitter.

2. The clip of claim 1 further including a battery-holding compartment, the compartment being sized and shaped to hold one or more batteries and place the one or more batteries in electrical communication with either or both of the first light system and second system.

3. The clip of claim 1 wherein the first light system is held by a light holder and the top surface of the first panel at its proximal end includes structure that supports the light holder.

4. The clip of claim 1 wherein the second light system or the at least one second light emitter of the second light system is pivotable from the second panel.

5. The clip of claim 1 wherein the first light system or the at least one first light emitter of the first light system is pivotable.

6. The clip of claim 1 wherein the bottom surface of the first panel is concave.

7. The clip of claim 1 wherein a portion of the top surface of the second panel is convex, texturized or both.

8. The clip of claim 1 wherein the nose segment has a brim facing surface and the brim facing surface is concave.

9. The clip of claim 1 wherein the distal end of the second panel includes a channel in the top surface of the second panel, the channel having a floor and a sidewall.

10. The clip of claim 1 wherein the wedge-shaped portion of the second panel is formed by a pair of flaring side segments, each of which connects to a distal segment at an obtuse angle.

11. A system for interchangeable mounting of lighting devices on a hat brim, the system comprising:

a clip body and one or more end-pieces;

the clip body comprising a first panel and a second panel, the first and second panels respectively having a length, width, top surface, bottom surface, proximal end and distal end;

the first panel and second panel each resiliently connected at their distal ends to a nose segment and having an intra-panel spacing between them;

the nose segment having a front-facing surface and a brim-facing surface;

the second panel having a wedge shaped portion in which the width of the panel increases from the distal end of the panel to the proximal end of the panel;

the proximal end of the first panel including a first attachment structure;

the one or more end-pieces including a second attachment structure sized and shaped for releasable attachment to the first attachment;

the one or more end pieces including a first light system, the first light system having at least one first light emitter; and a second light system depending from the second panel, the second light system having at least one second light emitter.

12. The system of claim 11 wherein the second light system or the at least one second light emitter is pivotable.

13. The system of claim 11 wherein the bottom surface of the first panel is concave.

14. The system of claim 11 wherein the top surface of the second panel is convex.

15. The system of claim 11 wherein the the brim facing surface is concave.

16. A clip body for interchangeable mounting of accessory devices on a hat brim, the clip body comprising:

a first panel and a second panel, the first and second panels respectively having a length, width, top surface, bottom surface, proximal end and distal end;

the first panel and second panel each resiliently connected at their distal ends to a nose segment;

the nose segment having a front-facing surface and a brim-facing surface;

the second panel having a wedge shaped portion in which the width of the panel increases from the distal end of the panel to the proximal end of the panel; and the proximal end of the first panel including a first attachment structure sized and shaped to releasably attach to a complementary second attachment structure connected to an end-piece.

17. The clip body of claim 16 wherein the second light system or the at least one second light emitter is pivotable.

18. The clip body of claim 16 wherein the bottom surface of the first panel is concave and the top surface of the second panel is convex.

19. The clip body of claim 16 wherein the brim facing surface is concave.

20. The clip body of claim 16 wherein the first panel and the second panel have an intra-panel spacing between them and the system further includes an insert, the insert being sized and shaped so as to be received by the clip body so as to reduce the intra-panel spacing between the first panel and second panel.

* * * * *